US005641614A

United States Patent [19]

Yamaya et al.

[11] Patent Number: 5,641,614

[45] Date of Patent: Jun. 24, 1997

[54] PROCESSING METHOD OF SILVER HALIDE PHOTOGRAPHIC LIGHT SENSITIVE MATERIAL

[75] Inventors: Akiko Yamaya; Yasunori Wada; Hirobumi Yamashita; Shoji Nishio, all of Hino, Japan

[73] Assignee: Konica Corporation, Japan

[21] Appl. No.: 550,249

[22] Filed: Oct. 30, 1995

[30] Foreign Application Priority Data

Nov. 8, 1994 [JP] Japan ..... 6-273959

[51] Int. Cl.[6] ..... G03C 5/395

[52] U.S. Cl. ..... 430/399; 430/398; 430/434; 430/455

[58] Field of Search ..... 430/398, 399, 430/434, 455

[56] References Cited

U.S. PATENT DOCUMENTS

| | | | |
|---|---|---|---|
| 4,217,188 | 8/1980 | Ono | 204/109 |
| 5,351,103 | 9/1994 | Komatsu et al. | 430/398 |
| 5,498,511 | 3/1996 | Yamashita et al. | 430/399 |

FOREIGN PATENT DOCUMENTS

| | | |
|---|---|---|
| 0329275 | 8/1989 | European Pat. Off. . |
| 0514069 | 11/1992 | European Pat. Off. . |
| 0611987 | 8/1994 | European Pat. Off. . |
| 0704756 | 3/1996 | European Pat. Off. . |

*Primary Examiner*—Hoa Van Le

*Attorney, Agent, or Firm*—Jordan B. Bierman; Bierman and Muserlain

[57] ABSTRACT

A method for continuously processing an exposed silver halide photographic light sensitive material comprises the steps of:

developing said material with a developing solution, the developing solution being replenished with a first water and a solid developing composition containing a developing agent and a first sulfite according to a processing amount of said material; and fixing the developed material with a fixing solution, the fixing solution being replenished with a second water and a solid fixing composition containing a fixing agent and a second sulfite according to a processing amount of said material, and no other processing being carried out between said developing and said fixing, wherein the second sulfite is replenished in an amount of 0 to 0.05 mol per liter of the second water.

11 Claims, 1 Drawing Sheet

PROCESSING METHOD OF SILVER HALIDE PHOTOGRAPHIC LIGHT SENSITIVE MATERIAL

FIELD OF THE INVENTION

The invention relates to a processing method for a silver halide photographic light sensitive material and particularly to a processing method for a silver halide photographic light sensitive material without deteriorating fixibility and drying property even when the processing was continuously carried out at a high speed.

BACKGROUND OF THE INVENTION

Currently, many photographic processing compositions are sold as concentrated solutions which are diluted at usage. However, the concentrated solutions are heavy and bulky, and an improvement in transport cost, storage space and operative efficiency has been strongly demanded. In order to solve this problem, a solid processing composition has been proposed. The solid processing composition is preferable in view of reduction of containers and an environmental improvement However, the solid processing composition has a problem in that it takes a long time to dissolve. That is, when the solid processing composition and water are replenished to a processing tank, the solid component is slow in dissolving and remains insoluble, resulting in deterioration of processing properties. Particularly, rapid processing is recently predominant, and development time is 30 seconds or less or a large amount of light sensitive materials such as 100m$^2$/hour are processed. Such a rapid and continuous processing caused marked dissolving retardation, resulting in deterioration of processing properties.

The deterioration of processing properties due to the above dissolving retardation includes sensitivity deviation in development or deterioration of fixibility or drying in fixing. In order to solve this problem, a method has been proposed in which the form of the solid composition is improved or a solid composition crushing means is provided on an automatic processor, but the method is not sufficient to solve the problem.

SUMMARY OF THE INVENTION

Accordingly, an object of the invention is to provide a method for processing a silver halide photographic light-sensitive material without deteriorating developability (such as sensitivity variation), fixibility and drying property even when the processing was continuously carried out at a high speed.

DETAILED DESCRIPTION OF THE INVENTION

Figure 1:
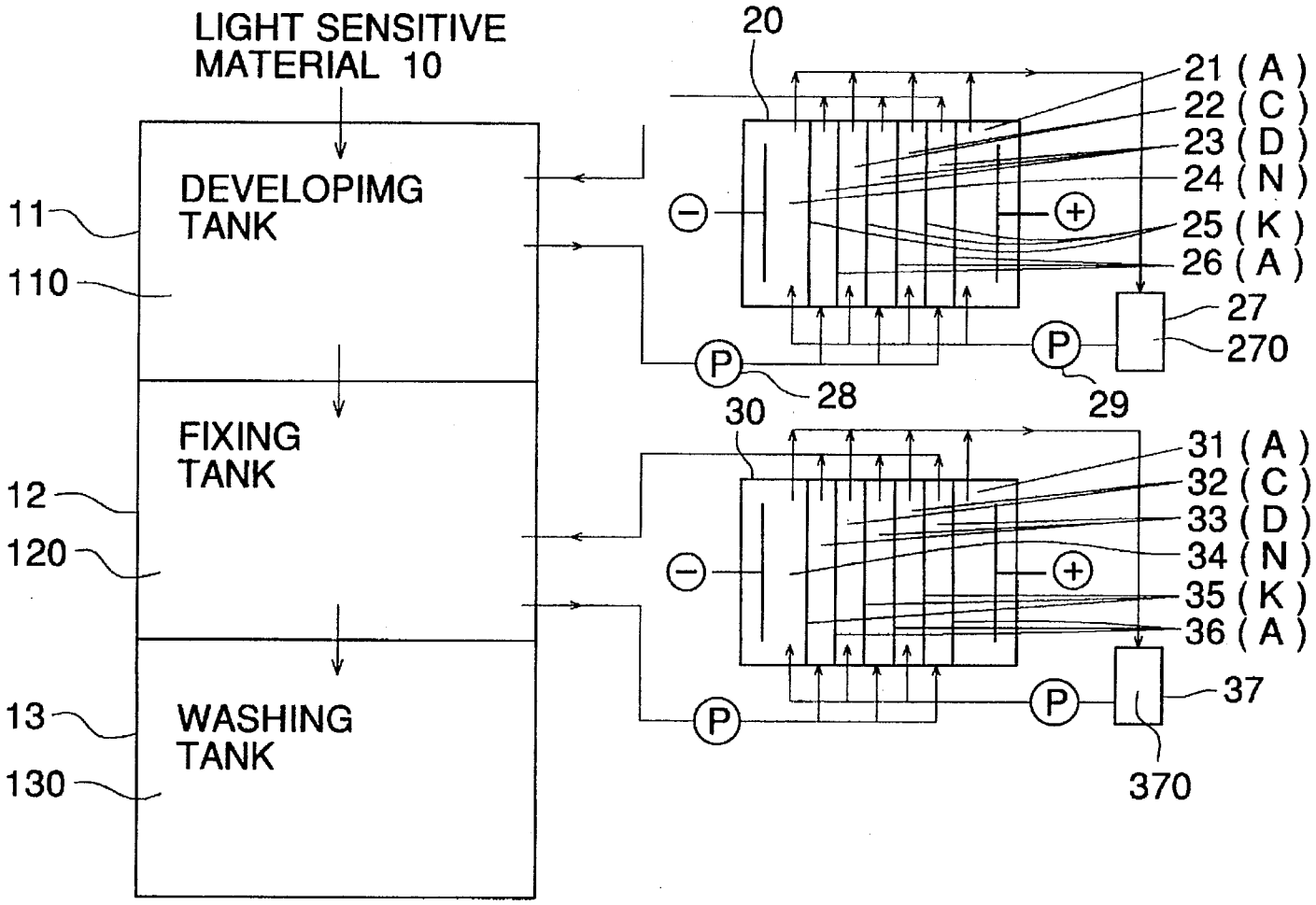
FIG. 1 is a plane view showing one example of the processor used in the invention.

The above objects of the invention have been attained by the followings:

(1) A method for processing a silver halide photographic light-sensitive material, using a processor having a developing tank charged with developer containing a developing agent and a sulfite and having a fixing tank charged with fixer containing a fix agent and 0.05 mol/liter or less of a sulfite, no other processing tank being provided between the developing tank and the fixing tank, the method comprising continuously processing the material, wherein the developer is replenished with water and a solid developing composition containing a developing agent and a sulfite, and the fixer is replenished with water and a solid fixing composition containing a fixing agent.

(2) The method of item (1), wherein the fixer is replenished with water in an amount of 300 cc/m$^2$ or less of light sensitive material having been processed.

(3) The method of item (1) or (2), wherein the sulfite content of the developer is 0.3 mol/liter or more.

(4) The method of item (1), (2) or (3), wherein the solid developing composition satisfies the following inequality:

$$[(M_{Na})/(M_K)]>1$$

wherein $M_{Na}$ represents a mol number of sodium sulfite contained in 1 g of the solid developing composition; and $M_K$ represents a mol number of potassium sulfite contained in 1 g of the solid developing composition.

(5) A method for processing an exposed silver halide photographic light-sensitive material with a processing solution contacting a solution containing an electrolyte, the processing solution being directly replenished with a solid processing composition for a silver halide photographic light-sensitive material, wherein the method comprises electrifying, at least through an anion exchange membrane, the processing solution.

(6) The method of item (1), (2), (3) or (4), wherein the method comprises processing an exposed silver halide photographic light-sensitive material with a processing solution contacting a solution containing an electrolyte, the processing solution being directly replenished with a solid processing composition for a silver halide photographic light-sensitive material, wherein the method comprises electrifying, at least through an anion exchange membrane, the processing solution.

(7) The method of item (5) or (6), wherein the replenishing amount of water for dissolving the solid processing composition is 300 cc/m$^2$ or less of light sensitive material having been processed.

(8) The method of item (5), (6) or (7), wherein the processing speed of the silver halide photographic light sensitive material is 20 m$^2$ per hour or more.

The objects of the invention could be attained by a method increasing the dissolving speed by reducing the sulfite content of a solid fixing composition, a method recovering a deteriorated fixibility by specifying a ratio of a sodium ion concentration to a potassium ion concentration in a developer, or a method increasing the dissolving speed of by removing undesired salts from processing solutions.

The fixer contains a sulfite (a sulfite component) as a preserver of a thiosulfate. The sulfite content is preferably less, since the sulfite component is slow in dissolving and has an great adverse effect on the dissolving speed of a solid processing composition. On the other hand, the developer also contains a sulfite (a sulfite component) as a preserver of the developer, and the developer overflows to the fixer carried by the processed material on processing. Accordingly, since the sulfite is supplied to fixer from the developer on processing, the replenishing amount of the sulfite to the fixer may be less. Especially when the replenishing amount of fixer replenisher is less, the ratio of the overflowed developer to the fixer is higher and the replenishing amount of the sulfite to the fixer is less. The conventional solution kit is likely to be subjected to oxidation decomposition in the form of concentrated kit or diluted solution for use, and requires the sulfite component to prevent oxidation. The solid fixing composition markedly reduces decomposition of a thiosulfate, the addition of the sulfite for preventing the decomposition is not necessary and the sulfite component content can be decreased in the solid fixing kit.

Another method of improving solubility includes one removing a salt through an anion exchange membrane. When developing is carried out, a sodium or potassium halogenide occurs and causes an increase of a salt strength. The salt strength increases in a fixer since developer overflows to the fixer together with dissolution of silver halide. In view of the above, the solubilizing speed of the solid processing composition could be increased by removing the undesired ion. According to this method, processability could be improved. In development, fluctuation such as sensitivity lowering has been restrained, and in fixing, deterioration of fixibility due to a solubility retardation of a fixing agent or drying deterioration due to a solubility retardation of an aluminium component has been prevented.

The fixibility deterioration due to a solubility retardation of a solid processing composition could be improved by specifying the ratio of a potassium ion to a sodium ion of a sulfite in developer. The sodium ion is preferable since a potassium ion in the developer overflows to the fixer, resulting in the fixer deterioration. A method using a sodium ion was not preferable in liquid form since the kid volume of a concentrated developer increased in view of solubility of the sodium salt. However, in the solid form the volume was not increased and the fixing property was improved even if the sodium salt is used instead of the potassium salt of a sulfite. The object of the invention has been attained by the above mentioned.

The invention will be detailed below.

The solid processing composition of the invention is in the form of powder described above or tablets, pellets or granules, and is optionally subjected to anti-humidity treatment.

The powder referred to in the invention is aggregates of fine crystals. The granules referred to in the invention are obtained by granulating the powder, and the granules have a particle diameter of 50 to 5000 μm aggregates of fine crystals. The tablets referred to in the invention is one obtained by compression-molding powder or granules into a definite form.

In order to prevent variation of photographic properties, it is effective to reduce an aperture value of a developer tank in an automatic processor. The aperture value is preferably 80 $cm^2$/liter or less. When the aperture value exceeds 80 $cm^2$/liter, insoluble solid processing agents or concentrated solutions immediately after dissolving the solid agents are likely to be subjected to air oxidation and produce insoluble matters and scums, resulting in problems of producing stainings in the processor or light sensitive materials processed. These problems can be solved in the case of a 80 $cm^2$/liter or less aperture value. The aperture value referred to herein is an area per unit volume at which a processing solution contacts an atmospheric air. The unit volume is in terms of $cm^2$/liter. The aperture value of the invention is preferably 80 $cm^2$/liter or less, more preferably 50 to 3 $cm^2$/liter, and still more preferably 35 to 10 $cm^2$/liter.

The aperture value can be reduced generally by using a floating cover for shielding air which is made of a resin or by using a slit type processing tank disclosed in Japanese Patent O.P.I. Publication Nos. 63-131138/1988, 63-216050/1988 and 63-235940/1988.

In the automatic processor in the invention, the processing solution is preferably circulated continuously by driving the pump for a specific time necessary to dissolve the solid processing composition, even after the processing of light sensitive materials is completed and the transporting of the materials is stopped. The time driving the pump from the completion of processing is preferably 2 hours or less. More preferably 10 to 70 minutes, and still more preferably 15 to 50 minutes. It is not preferable in view of operability, energy saving, deterioration of the processing solution or clog of the filter. On the contrary, the dissolution of the solid composition is not sufficient if the time is too short.

In order to solidify the photographic processing composition, any method can be used in which concentrated solution or a mixture of fine-powdered or granuled processing agents with a water soluble binder is kneaded and molded or pre-molded processing agent is coated with a covered layer by spraying a water soluble binder. (See JP Application Nos. 2-135887/1990, 2-203165/1990, 2-203166/1990, 2-203167/1990, and 2-300405/1990.)

The preferable method for preparing tablets is a method in which a powedered processing composition is granulated and the resulting granules are tableted to obtain tablets. The tablets prepared by the above have advantages that solubility and storage stability are improved and stable photographic properties are obtained as compared with those prepared by the method that the solid processing composition is only mixed and then tableted.

As for the granulating processes for forming tablets, it is possible to use any of the well-known processes such as the processes of a rolling granulation, an extrusion granulation, a compression granulation, a cracking granulation, a stirring granulation, a fluidized-layer granulation and a spray-dry granulation. When the granules are mixed and compressed to obtain tablets, the average particle size of the granules is to be within the range of preferably 100 to 800 μm and more preferably 200 to 700 μm in that localization of components or so-called segregation occurs with difficulty. As to particle size distribution, not less than 60% of the granules have a deviation of preferably ±200 to 250 μm. The granules are used as they are.

When the granules are compressed, the well known compressors such as a hydraulic press machine, a single tableting machine, a rotary tableting machine and a bricketing machine can be used. The resulting solid processing composition may be in any form, and preferably in cylindrical form in view of productivity, handling or loose powder occurred in use.

It is preferable that each component, for example, an alkali agent, a reducing agent, a bleaching agent, or a preservative, is separately granulated. As a result, the above effects become more remarkable.

A tablet type processing composition can be prepared in any well known process or the method detailed in JP OPI Publication Nos. 51-61837/1976, 54-155038/1979 and 52-88025/1977 and British Patent No. 1,213,808. Also, the preparation of the granulated processing composition is detailed in JP OPI Publication Nos. 2-109042/1990, 2109043/1990, 3-39735/1991 and 3-39739/1991. Further, a powder type processing composition can be prepared in any well known process as detailed in JP OPI Publication No. 54-133332/1979, British Patent Nos. 725,892 and 729,862 and German Patent No. 3,733,861.

From the viewpoint of solubility and the desired effect of the present invention, the bulk density of the solid photographic processing composition described above is preferably 1.0 to 2.5 g/$cm^3$; this range is preferable from the viewpoint of solid strength for the lower limit and solid solubility for the upper limit. When the solid processing composition is of granule or powder form, the bulk density is preferably 0.40 to 0.95 g/cm$^3$.

Although the solid processing composition for the present invention may be used for various photographic processing agents such as developer, a fixer and a rinsing agent, the effect of the invention, particularly the photographic performance stabilizing effect, is enhanced when it is applied to the developer.

Although solidification of part of a processing composition is included in the scope of the present invention, it is preferable to solidify the entire components of the processing composition. Desirably, each component is formed as a separate solid processing agent and packaged in the same package. It is also desirable to package each component in the order of repeated addition.

It is preferable to add all processing agents to be supplied to respective processing tanks according to information on the amount of processing in the form of solid. Where necessary, replenishing water is supplied on the basis of such information or other replenishing water controlling information. In this case, the liquid added to the processing tanks may be replenishing water alone. In other words, when two or more processing tanks require replenishment, by sharing the replenishing water, only one tank is sufficient to store the replenishing liquid, resulting in automatic processor size reduction. The replenishing water tank may be installed outside or inside the automatic processor machine. It is preferable in view of space saving that the replenishing water tank be installed inside the automatic processor.

In solidifying a developing composition, it is preferable to solidify all of an alkali agent and reducing agent, and to confine the number of tablet kinds to not more than 3, preferably 1. When solidifying in two or more agents, it is preferable to package these tablets or granules in the same package.

The solid processing composition of the invention can be packaged with the following materials:

A moisture-resistive packaging material for the solid processing composition of the invention can be embodied by making use of the following materials.

As for a synthetic resin material, any material can be used upon selecting them from the group consisting of polyethylene (prepared in either a high-pressure method or a low-pressure method), polypropylene (prepared in either a non-stretching method or a stretching method), polyvinyl chloride, polyvinyl acetate, Nylon (either stretched or non-stretched), polyvinylidene chloride, polystyrene, polycarbonate, Vinylon, Eval, polyethylene terephthalate (PET), other polyesters, rubber hydrochloride, acrylonitrile-butadiene copolymer and an epoxy-phosphoric acid type resin (that is a polymer described in JP OPI Publication Nos. 63-63037/1988 and 57-32952/1982). Besides the above, a pulp may also be used.

The material is preferably made of a single material, but, as film is used one which a synthetic resin film is laminated or coated or one of single layer.

It is more preferable to use various gas-barrier layers. For example, either an aluminium foil or an aluminium-vacuum-evaporated synthetic resin is interposed between the above-mentioned two synthetic resin films.

The total oxygen transmittance of the packaging material is not higher than 50 ml/m$^2$ 24 hr/atm (at 20° C. and 65%RH) and, preferably, not higher than 30 ml/m$^2$ 24 hrs/atm in view of storage stability or prevention of staining occurrence.

The total layer thickness of the laminated layer or single layer is 1 to 3000 μ, preferably 10 to 2000 μm and, more preferably 50 to 1000 μm.

The above-mentioned synthetic resin film may consist of either a single (macromolecular) resin film or a film in which two or more resins are laminated.

The single macromolecular resin film satisfying the requirements for the invention includes, for example, (1) polyethylene terephthalate (PET) having a thickness of not thinner than 0.1 mm;

(2) an acrylonitrile-butadiene copolymer having a thickness of not thinner than 0.3 mm; and (3) a hydrochloric rubber having a thickness of not thinner than 0.1 mm.

Among the above, polyethylene terephthalate can suitably be applied to the invention, because it is excellent in alkali resistance and acid resistance, too.

Next, a laminated macromolecular resin film satisfying the requirements for the invention includes, for example, (4) PET/polyvinyl alcohol-ethylene copolymer (Eval)/polyethylene (PE);

(5) stretched polypropylene (OPP)/Eval/PE;

(6) unstretched polyproylene (CPP)/Eval/ PE;

(7) Nylon (N)/Aluminium foil (Al)/PE;

(8) PET/Al/PE;

(9) Cellophane/PE/Al/PE;

(10) Al/paper/PE;

(11) PET/PE/Al/PE;

(12) N/PE/Al/PE;

(13) paper/PE/Al/PE;

(14) PET/Al/PET/polypropylene (PP);

(15) PET/Al/PET/high-density polyethylene (HDPE);

(16) PET/Al/PE/low-density polyethylene (LDPE);

(17) Eval/PP;

(18) PET/Al/PP;

(19) paper/Al/PE;

(20) PE/PVDC-coated Nylon/PE/ethylvinyl acetate-polyethylene condensate (EVA);

(21) PE/PVDC-coated N/PE;

(22) EVA/PE/Aluminium-evaporated Nylon/PE/EVA;

(23) aluminium-evaporated Nylon/N/PE/EVA;

(24) OPP/PVDC-coated N/PE;

(25) PE/PVDC-coated N/PE;

(26) OPP/Eval/LDPE;

(27) OPP/Eval/CPP;

(28) PET/Eval/LDPE;

(29) ON (stretched Nylon/Eval/LDPE; and

(30) CN (unstretched Nylon)/Eval/LDPE.

Among them, the above-given (20) through (30) may preferably be used.

Further, the foregoing packaging material is typically constituted of the following component arrangements in the order from the inside thereof, provided when the side attached to a processing composition is regarded as the inside.

PE/paper sheet as a principal member/PE/Al/an epoxy-phosphoric acid type resin layer/a polyester type resin layer/PE;

PE/K-Nylon/PE or an adhesive/Al/PE/paper sheet/PE;

PE/Vinylon/PE or an adhesive/Al/PE/paper sheet/PE;

PE/vinylidene chloride/PE or an adhesive/Al/PE/paper sheet/PE;

PE/polyester/PE or an adhesive/Al/PE/Paper sheet/PE; and

Polypropylene/K-Nylon/polypropylene/Al/polypropylene/paper sheet/polypropylene.

A mode of moisture-resistibly packaging powder, tablet or granule includes, for example, 4-side sealing;

3-side sealing;

Stick-sealing (such as a pillow type or gusset type packaging);

PTP sealing; and

Cartridge sealing.

Four-side sealing mode, 3-side sealing mode and stick-sealing mode (such as a pillow or cassette type sealing mode) are different in shape from each other and the above-given materials may be used therein, provided, when these modes are used in a peal-open system, a sealant is laminated so as to provided them with a peal-open aptitude.

As for the above-mentioned peal-open system, there are, ordinarily, a cohesion-rupture system, an interface pealing system and a interlayer pealing system.

To be more concrete, the cohesion-rupture system is a system in which an adhesive so-called a hot-melt and a heat-seal lacquer are both used as a sealer. When opening a package, the inside of a sealant layer is cohesion-ruptured and thereby the package is peal-opened.

The interface pealing system is a system for pealing on the interface between films, in which a sealing film (that is a sealant) and an adherend are not completely fused together and, therefore, they can be pealed apart by applying an appropriate force. The sealant is a film prepared by mixing plural tacky resins up, and it may be selected out of the group consisting of polyethylene, polypropylene and a copolymer thereof, a polyester and so forth, so as to meet a material of the adherend.

The foregoing interlayer pealing system is a system in which a multilayered extrusion film such as a laminated film is used as a sealant and a pealing is then made on the interface between the laminated layers of the film.

Among the peal-open systems applied with a film of the invention, an interlayer pealing system and an interface pealing system are preferable.

Because such a sealant as mentioned above is thin, it is usual to use it upon laminating it on any one of the other films including, for example, those made of polyethylene, polypropylene, polystyrene, polycarbonate, polyester (such as polyethylene terephthalate), polyvinyl chloride, Nylon, Ever, or aluminium. However, taking a moisture resistance, an environmental aptitude and a compatibility with a content into consideration, polyethylene, polypropylene, polyester and ever may preferably be used. Also, taking a printability into consideration, the outermost surface is preferable to be comprised of, for example, a unstretched polypropylene polyester and paper sheet.

A sealant includes, for example, CMPS film manufactured by Tocello Co., Difran PP-100 and PS-300 each manufactured by Dai-Nippon ink Chemical Co., LTS film manufactured by Toppan Printing Co. and San-Seal FR and MS each manufactured by Sanei Chemical Co. A type thereof which already laminated with a polyester include, for example, Dikran C-1600T and C-1602T.

PTP has a packaging mode in which a solid type processing composition is put in a PVC- or CPP-made sheet-shaped package that is a blister type package and then the package is heat-sealed by making use of an aluminium sealing material.

From the viewpoint of preserving the environment to be safe, A-PET and a high moisture resistive PP (such as TAS-1130, TAS-2230 and TAS-3230 each manufactured by Taisei Chemical Industrial Co.) have recently been preferably used, while there has been a tendency to ban the use of PVC as a packaging material.

When packaging, binding or covering a processing composition by making use of a water-soluble film or a binder, a water-soluble film or binder preferably applicable thereto include, for example, those comprising the following basic materials, namely, those of polyvinyl alcohol, methyl cellulose, polyethylene oxide, starch, polyvinyl pyrrolidone, hydroxypropyl cellulose, pullulan, dextran, gum arabic, polyvinyl acetate, hydroxyethyl cellulose, carboxyethyl cellulose, sodium carboxymethyl hydroxy ethyl cellulose, poly(alkyl)oxazoline and polyethylene glycol. Among them, those of the polyvinyl alcohol type and pullulan type are preferably used, from the viewpoint of a covering or binding effect.

Polyvinyl alcohol is an especially suitable film-forming material and is also excellent in strength and softness under almost all conditions. A polyvinyl alcohol composition available on the market for casting it into a film has a variety of molecular weight ranges and hydrolyzing degrees, however, it is preferable to have a molecular weight within the range of about 10000 to about 100000. A hydrolyzing degree herein means a ratio of an acetic acid ester group of polyvinyl alcohol to be substituted by an hydroxyl group. In the case of a film, the degrees of a hydrolysis is usually within the range of about 70% to 100%. As mentioned above, the term, "polyvinyl alcohol", usually includes a polyvinyl acetate compound.

The above-mentioned water-soluble film is prepared in such a common preparation process as described in, for example, JP OPI Publication Nos. 2-124945/1990, 61-97348/1986, 60-158245/1985, 2-86638/1990, 57-117867/1982, 2-75650/1990, 59-226018/1984, 63-218741/1988 and 54-13565/1979.

As for these water-soluble films, it is allowed to use those available on the market, under the brand names of, for example, Solpuron (manufactured by Ai-Cello Chemical Co.), Hicellon (manufactured by Nichigo Film Co.) and pullulan (manufactured by Hayashibara Co.). In particular, Series of 7-000 of polyvinyl alcohol film available from Mono-Sol Division of Chris Craft Industries, Inc. can preferably be used, because it may be dissolved in water, without harm, at a temperature within the range of about 34° F. to about 200° F. and shows a high chemically resistant property.

The above-mentioned water-soluble film preferably applicable thereto has a thickness within the range of 10 to 120 μ, preferably 15 to 80 μ and more preferably 20 to 60 μ, from the viewpoints of the preservation stability of a solid type processing composition, a period of time required for dissolving the water-soluble film and the crystal deposition produced inside an automatic processor.

It is also preferable that a water-soluble film is of the thermoplastic type. This is not only because a heat-sealing process and a supersonic welding process may readily be performed, but also because a covering effect may more excellently be displayed.

Further, the tensile strength of a water-soluble film is within the range of, preferably $0.5\times10^6$ to $50\times10^6$ kg/m$^2$, more preferably $1\times10^6$ to $25\times10^6$ kg/m$^2$ and, particularly $1.5\times10^6$ to $10\times10^6$ kg/m$^2$. Such a tensile strength as mentioned above can be measured in conformity of the method specified in JIS Z-1521.

A photographic processing composition packaged, bound or covered by a water-soluble film or a binder is preferable to be packaged with a moisture resistive material, for such a purpose that a high moisture including, for example, the atmospheric moisture such as rain and mist, and an accidental damage produced by spattering or touching the composition by wet hand may be prevented in the course of storing, transporting or handling the composition. As for such a moisture resistive material as mentioned above it is preferable to use a film having a thickness within the range of 10 to 150 μ. The moisture resistive material is preferable to be at least one selected from the group consisting of the following film or a composite material thereof; namely, a polyolefin film such as those made of polyethylene terephthalate, polyethylene and polypropylene; a craft paper capable of showing a moisture resistant effect displayed by polyethylene; a wax paper; a moisture resistive cellophane; glassine, polyester, polystyrene, polyvinyl chloride, polyvinylidene chloride, polyamide, polycarbonate, acrylonitrile; a metal foil such as that made of aluminium; and a metallized polymer.

In an embodiment of the invention, it is preferable to use a moisture resistive packaging material comprising a decomposable plastic including, particularly, a biodegradable or photolysable plastic.

The biodegradable plastics include, for example, (1) a plastic comprising natural macromolecules, (2) a microbially produced polymer, (3) a synthetic polymer having a well biodegradation property, and (4) a plastic compounded with a biodegradable natural macromolecule. The photolysable plastics include, for example, (5) a plastic excited by UV rays and having a group capable of cutting a chain made present on the principal chain thereof. Besides the above-given macromolecules, those having both of the two functions, a photolysability and a biodegradability together, may effectively be used.

The typical examples thereof will typically be given below.

The biodegradable plastics include, for example, (1) A natural macromolecule;

A polysaccharide, a cellulose, a polylactic acid, chitin, chitosan, a polyamino acid, or a modified matter thereof;

(2) A microbially produced polymer;

"Biopol" comprising PHB-PHV (a 3-hydroxybutylate-3-hydromy valeate copolymer) and a microbially produced cellulose;

(3) A synthetic polymer having a well biodegradation property;

A polyvinyl alcohol, a polycaprolactone, and a copolymer or mixture thereof; and (4) A plastic compounded with a biodegradable natural macromolecule;

A natural macromolecule having a well biodegradability include starch and a cellulose. It is added to a plastic to provide a shape-decaying property to the compound.

As for the examples of photo-degrading property, there are compounds where a carbonyl group is introduced. Besides, there may be some cases where a UV absorbent may be added to accelerate photo-degradation.

As for such a decomposable plastic as mentioned above, those described in, for example, "Kagaku To Kogyo", Vol. 64, No. 10, pp. 478–484, (1990); and "Kinozairyo", July, 1990 Issue, pp. 23–34 can be used. It is also allowed to use the decomposable plastics available on the market including, for example, Biopol, by I.C.I., Eco, by Union Carbide.; Ecolite, by Eco Plastic Co.: Ecostar, by St. Lawrence Starch Co.; and Knuckle P, by Japan-Unicar Co., respectively.

The above-mentioned moisture resistive packaging material has a moisture transmission coefficient of, preferably, not higher than 10 g·mm/m$^2$/24 hrs and, more preferably, 5 g·mm/m$^2$/24 hrs.

As for the means of supplying a solid processing composition to a processing tank in the invention and in the case that the solid processing composition is of the tablet type, for example, there is such a well-known means as described in JP Utility Model Nos. 63-137783/1988, 6397522/1988 and 1-85732/1989. In short, any means can also be used for this purpose, provided, the means has at least a function for supplying a tablet to a processing tank. In the case that a solid processing composition is of the granule or powder type, there is a well-known means such as a gravitationally dropping type means described in Japanese Utility Model OPI Publication Nos. 62-81964/1987, 63-84151/1988 and JP OPI Publication No. 1-292375/1989 and such a propeller or screw type means as described in Japanese OPI Utility Model Publication Nos. 63-105159/1988 and 63-195345/1988. However, the invention shall not be limited thereto.

As for a preferable means for supplying a solid processing composition to a processing tank, it may be considered to use such a means, for example, that a specific amount of a solid processing composition already weighed and separately put in a package in advance is opened and taken out of the package so as to meet the quantity of light-sensitive material to be processed. To be more concrete, every specific amount of a solid processing composition, that is preferably a replenishing amount thereof for every replenishment, is contained in a package that is sandwiched between at least two packaging materials, and the amount of the composition is then made to be in a state where it can be taken out by separating the packages to two directions or opening a part of the processing composition. The processing composition in the state where it can be readily taken out can be readily supplied to a processing tank provided with a filtering means by naturally dropping the composition. A specific amount of every processing composition is put in a separate tight-sealed package so that the atmospheric air and the aeration between it and any other solid processing composition adjacent thereto can be shielded. Therefore, the composition can be secured to resist any moisture invasion.

As for an embodiment of the invention, the following constitution may be considered that a package is so comprised of at least two packaging materials as to sandwich a solid processing composition between the packaging materials, and the two packaging materials are brought into close contact with or are made adhered to each surface thereof so that the surroundings of the processing composition can be separated apart. When the two packaging materials sandwiching the processing composition between them is pulled toward the different directions from each other, the close contacted or adhered surfaces are separated apart, so that the processing composition can be made in the state where it is ready to be taken out.

As for another embodiment of the invention, it may be considered that a package is so composed of at least two packaging materials as to sandwich a solid processing composition between the packaging materials, and one of the two packaging materials can be opened by applying an external force. The expression "to open a package" herein means a partial notch or partial cut of a packaging material remaining the rest thereof unnotched or uncut. A method of opening a package is that a compression is applied from a package on the side of not opening it, through a solid processing composition, to the direction of the other package to be opened, so that the solid processing composition is forcibly pushed out. Or, it may also be considered that a solid processing composition is made ready to be opened by making a partial cut or notch on a package on the side where the package is to be opened by making use of a sharp-edged member.

A supply starting signal is generated by detecting information on the amount of processing. A supply stopping signal is generated by detecting information on the completion of supply of a specified amount. When a processing agent is packed separately and it is necessary to unseal it, upon reception of such supply starting signal, the driving means for separation or opening, and upon reception of such supply stopping signal, the driving means for separation or opening is disabled.

The above solid processing agent supplying means is equipped with a controlling means for adding a given amount of the solid processing agent according to information on the amount of processing of light-sensitive material, which constitutes a key to the present invention. It is essential for the automatic processing machine of the present invention to keep the component concentration in each processing tank constant and hence stabilize photographic performance. The information on the amount of processing of silver halide photographic light-sensitive material is a value in proportion to the amount of the silver halide photographic light-sensitive material to be processed by a processing solution or the amount of the silver halide photographic light-sensitive material already processed by a processing solution or the amount of the silver halide photographic light-sensitive material being processed by a processing solution, offering a direct or indirect index of the reduction in the amount of the processing agent in the processing solution. This information may be detected at any timing, before or after light-sensitive material transportation into the processing solution or during its immersion in the processing solution. It may also be physical parameters such as the concentration of the processing solution contained in the processing tank, concentration change, pH or specific gravity or the amount discharged after drying the processing solution.

Although any portion is acceptable to add the solid processing agent of the present invention, as long as it is located in the processing tank, preference is given to a portion communicating with the processing portion for the light-sensitive material and allowing the processing solution to flow to/from the processing portion. The preferred configuration is such that a given amount of processing solution is circulated to/from the processing portion to allow the dissolved components to be transferred to the processing portion. It is preferable to add the solid processing agent into a processing solution being warmed.

Usually, the automatic processing machine is equipped with an electric heater to warm processing solutions, wherein, as a general method, a heat exchanger is provided in the auxiliary tank connected to the processing layer, which auxiliary tank is equipped with a pump for supplying the solution at constant rate from the processing tank to have constant temperature.

A filter is usually arranged to remove crystalline foreign substances occurring due to contamination or crystallization in the processing solution.

It is most preferable to add the solid processing agent to a warmed portion communicating with the processing portion like this auxiliary tank. This is because the insoluble components of the added processing agent are isolated from the processing portion by the filtering portion to prevent the solids from entering the processing portion and adhere to the light-sensitive material etc. so that dissolubability of the solid processing agent becomes extremely favorable.

Also, when a processing agent receiving portion, along with the processing portion, is provided in the processing tank, it is preferable to provide a shield or another device to avoid direct contact of the insoluble components with the film etc.

For the filter and filtering apparatus, any material can be used, as long as it is commonly used in ordinary automatic processing machines, and the effect of the present invention is not affected by any particular structure or material.

A circulation cycle of a processing solution circulated by a circulating means in the invention is preferably 0.5 to 2.0 cycles/min, more preferably 0.8 to 2.0 cycles/min, 1.0 to 2.0 cycles/min is specifically more preferable. Owing to this, dissolution of solid processing agents is accelerated, and thereby, occurrence of a group of high concentration solution, occurrence of uneven density of processed light-sensitive materials. Here, the circulation cycle is defined to be the flow amount of liquid circulated, and when a liquid amount corresponding to the total liquid amount in the processing tank is counted as one time.

The processing solutions in processing tanks are preferably not less than 7 liters so that processing property such as sensitivity or $\gamma$ is not deteriorated, and more preferably not less than 10 liters. Especially, not less than 7 liters of the developer in a developing tank contribute to the effect of the invention.

The solid processing composition of the present invention is added to the processing tank respectively separate from the replenishing water. Aforesaid replenishing water is supplied from the replenisher water tank.

A mold-preventing means for a water-replenishing tank in the invention will be explained as follows. When the replacement rate in the water-replenishing tank falls to cause water to stay in the tank for a long time, scale is formed and after two or three hours from the formation of scale, water is decomposed and emits an offensive odor, which is a problem. Further, when the formed scale is directly mixed in a replenisher to be replenished, it adheres to the surface of a photographic light-sensitive material, causing streaks in the case of a color developing tank, causing insufficient desilvering in the case of a desilvering tank, and causing contamination in the case of a stabilizing tank. Thus, the scale deteriorates the value of finished commodities remarkably regardless of the type of a tank in which the scale is mixed. Therefore, it is necessary to clean periodically for removing the scale, which is very much time-consuming. Therefore, in order to remove this contamination, it is necessary to wash periodically, consuming extreme time. Therefore, a water-replenishing tank of the invention is provided with a mold-preventing means. The mold-preventing means can be attained by at least one means selected from the following group:

Chelating agent adding means,
Mold-preventing agent adding means,
Deionizing processing means,
UV irradiation means,
Magnetic processing means,
Ultrasonic processing means,
Electrolytic sterilization means,
Silver ion discharging means,
Air-foaming means,
Free radical releasing means,
Means by contacting a multi-hole material,
Means by adding other nonharmful bacteria.

These means will be explained concretely as follows. Chelating agents and sterilizing agents used as a mold-preventing means in the invention include compounds described on page 398 of No. 6, Vol. 9 of "Water Quality Criteria" Phot Sci. and Eng. by L. E. West (1965), described in Vol. 85 of "Microbiological Gro with in Motion-Picture Processing" SMPTE Journal by M. E. Beach (March 1976), described on page 239 of No. 6, Vol. 10 of "Photoprocessing Wash Water Biocides" J. Imaging Tech. by R. O. Deegan (Dec. 1984) and described in Japanese Patent O.P.I. Publication Nos. 8542/1982, 105145/1983, 157244/1982 and 220951/1987.

As a chelating agent, those including ethylenediaminetetraacetic acid, diethylenetriaminepentaacetic acid, 1-hydroxyethylidene-1, 1-diphosphonic acid and ethylenediaminetetra (methylenephosphonic acid)

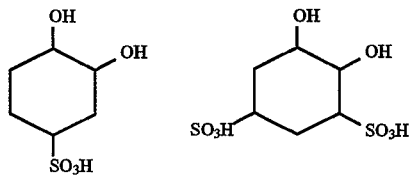

are preferable, while as a sterilizing agent, phenol type compounds, thiazole type compounds and benztriazole type compounds are preferable. As concrete examples, 1,2-benzisothiazoline3-on, 2-methyl-4-isothiazoline3-on, 2-octyl-4-isothiazoline3-on, 5-chloro-2-methyl-4-isothiazoline3-on, 0-phenylfersodium, and benztriazole are given as a preferable compound. With regard to these compounds, it is preferable that they are in a tablet shape when they are packed collectively, while it is preferable that they are in an individual package corresponding in weight to one replenishment when they are separately weighed.

With regard to the means for adding the aforementioned compounds, they may be added manually by those who prepare solutions, but it is preferable that a device for feeding solid processing agents of the invention is provided for adding them, and it is further preferable from a viewpoint of maintenance free that a water-replenishing tank is provided with a detector through which the compounds are added automatically when water is replenished up to a certain level on the tank.

A means for modifying water by means of ion-exchange resins in the invention can work based on the means described in Japanese Patent O.P.I. Publication No. 131632/1986.

As ion-exchange resins, there are various types of cation-exchange resins (strongly acidic cation-exchange resin, weakly acidic cation-exchange resin) and various types of anion-exchange resins (strongly basic anion-exchange resin), and these can be used independently or in combination. Normally, it is preferable to use both strongly acidic H type cation-exchange resins and weakly basic OH type anion-exchange resins. They may be applied on a water-replenishing tank, or water may be modified separately.

As a preferable strongly acidic ion-exchange resin, there by be given DIAION SKIB, SK102, SK104, SK106, SK110, SK112 and SK116 (made by Mitsubishi Kasei), while, as a preferable strongly basic anion-exchange resin of an OH type, there may be given DIAION, PA406, PA408, PA412, PA416 and PA418 made by Mitsubishi Kasei.

The UV irradiation means of the invention can work based on the means described in Japanese Patent O.P.I. Publication No. 263939/1985. As a UV irradiation device, those made by Kindai-Baio Lab. (with Head Office located at Kobe City) are small in size and can be used preferably. The means for giving a magnetic field in the invention can work based on the means described in Japanese Patent O.P.I. Publication No. 26393/1985. The means for giving a ultrasonic wave in the invention can work based on the means described in Japanese Patent O.P.I. Publication No. 263940/1985. The means for giving an electrolysis in the invention can work based on the means described in Japanese Patent O.P.I. Publication No. 22468/1991. A means for discharging Ag ions in the invention includes those wherein silver leaves or silver plates are put in a water-replenishing tank, or internal surfaces of the tank is coated with silver, or silver ion discharging compounds are put in the tank.

The air foaming means in the invention can be a means for blowing air bubbles in a water-replenishing tank which is extremely simple, and it is selected according to the size of the water-replenishing tank. From the viewpoint of miniaturization and economy, ①, ②, ③ and ⑧ are selected preferably as a means for preventing scale and microbes. Among these mold-preventing means, ①, ② and ⑦ are preferable.

Silver-ion-emitting compounds indicated in means (8) include organic acid silver such as silver chloride, silver bromide, silver iodide, silver oxide, silver sulfate and silver acetate, silver oxalate, silver behenate and silver maleate.

Those used preferably in the invention among the silver compounds mentioned above include one wherein $SiO_2$—$Na_2O$ lath objects having the chemical structure of a network structure type are basic structural components, and one wherein the silver compounds mentioned above are contained in zeolitic substance having the three-dimensional skeletal structure wherein $SiO_4$ tetrahedron and $AlO_4$ tetrahedron both having the structure of a methane type own one oxygen atom jointly.

As a zeolitic substance and a glass substance both containing the silver compounds and the compounds both mentioned above, there may be given Bio-Sure SG made by Kinki Pipe Laboratory, Opargent tablets made by Opofarma Co. and Zeomic made by Sinanen Zeomic Co.

A zeolitic substance and a glass substance both containing the silver compounds and the compounds both related to the invention can be used in various forms. For example, they may be in a form of powder, a sphere, a pellet, a fiber or a filter, or they may be used after being pushed, through kneading, in fibers of cotton, wool or of polyester. Concrete examples of them include SANITER 30 made by KURARE CO. and others.

Among the foregoing, those in a form of a filter and a sphere represent preferable embodiments.

In addition, it is another preferable embodiment of the present invention that a zeolitic substance and a glass substance both containing the silver compounds and the compounds are contained in a plastic case or a tea bag type water-permeable container to be used. In addition, Clinka 205 produced by Nichiita Kenkyuusho Co. Ltd. and Rakkin produced by Pacific Chemical can also be preferably used.

The solid processing composition in the invention preferably contains saccharides (monosaccharides or polysaccharides, in which monosaccharides are glycoside combined each other, or decomposites thereof) disclosed in Japanese Patent Application No. 6-91987/1994 (pages 23–30), and more preferably contains compounds selected from dextrins and sugar alcohols. Such a solid processing composition has no shape change during long term storage, no trouble in supplying and improved handling property.

The solid processing composition in the invention preferably contains, as lubricants, acylated amino acids disclosed in Japanese Patent Application No. 5-186254/1993 (pages 9–15). Such a solid processing composition has no deterioration in dissolving, no dust occurrence and improved storage stability, and can be stably manufactured.

The solid processing composition in the invention preferably contains, as coating agents, hydroxylamines, phenylcarboxylic acids, phenylsulfonic acids, hydroxylated or carboxylated alkyl (or alkenyl) carboxylic acids, sulfites, water soluble polymers (polyalkylene glycol, betaine type methacrylic acid polymers) or saccharides disclosed in Japanese Patent Application No. 6-70860/1994 (pages 14–33). Such a solid processing composition has no fine powder occurrence, no deterioration in dissolving, improved storage stability and superior photographic properties.

The developer in the invention preferably contains, as developing agents, dihydroxybenzenes, aminophenols or pyrazolidones disclosed in Japanese Patent Application No. 4-286232/1992 (pages 19–20), or reductones disclosed in Japanese Patent O.P.I. Publication No. 5-165161/1993. Of pyrazolidones, one having a substituent at 4-position, dimeson or dimeson S, is especially preferable in view of water solubility or storage stability of solid developer.

The concentration of a developing agent in developer is preferably not less than 0.5 mol %, and more preferably not less than 1.0 mol %, in that processing stability is not deteriorated.

As a preservative can be used sulfites disclosed in Japanese Patent Application No. 4-286232/1992 or organic reducing agents. Besides the above, chelating agents or bisulfite adducts of hardeners disclosed in Japanese Patent Application No. 4-586323/1992 (pages 20–21) are used. As a antisludging agents are preferably used compounds disclosed in Japanese Patent Application No. 4-92947/1992 or compounds (Formula [4-a] or [4-b]) disclosed in Japanese Patent Application No. 5-96118/1993. Cyclodextrins are also preferable, and compounds disclosed in Japanese Patent O.P.I. Publication No. 1-124853/1989 are especially preferable.

Amines can be added to the developer in the invention, and compounds disclosed in U.S. Pat. No. 4,269,929 are especially preferable.

The developer used in the present invention needs to contain a buffer. Examples of buffers include sodium carbonate, potassium carbonate, sodium bicarbonate, potassium bicarbonate, trisodium phosphate, tripotassium phosphate, disodium phosphate, sodium borate, potassium borate, sodium tetraborate (boric acid), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

As developing accelerators can be optionally added thioether compounds such as those disclosed in Japanese Patent Examined Publication Nos. 16088/1962, 5987/1962, 7826/1963, 12380/1969 and 9019/1970 and U.S. Pat. No. 3,813,247, p-phenylenediamine compounds such as those disclosed in Japanese Patent O.P.I. Publication Nos. 49829/1977 and 15554/1975, quaternary ammonium salts such as those disclosed in Japanese Patent Examined Publication No. 30074/1969 and Japanese Patent O.P.I. Publication Nos. 137726/1975, 156826/1981 and 43429/1977, the p-aminophenols disclosed in U.S. Pat. Nos. 2,610,122 and 4,119,462, the amine compounds disclosed in U.S. Pat. Nos. 2,494,903, 3,128,182, 4,230,796, 3,253,919, 2,482,546, 2,596,926 and 3,582,346 and Japanese Patent Examined Publication No. 11431/1966, polyalkylene oxides such as those disclosed in Japanese Patent Examined Publication Nos. 16088/1962, 25201/1967, 11431/1966 and 23883/1966 and U.S. Pat. Nos. 3,128,183 and 3,532,501, and 1-phenyl-3-pyrazolidones, hydrazines, meso-ionic compounds, ionic compounds and imidazoles.

As antifoggant can be used an alkali metal halide such as potassium iodide or organic antifoggants. The organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole and hydroxyazaindolidine, adenine and 1-phenyl-5-mercaptotetrazole as a representative.

In the developer of the present invention may be optionally used organic solvents such as methylcellosolve, methanol, acetone, dimethylformamide, cyclodextrins and compounds disclosed in Japanese Patent Examined Publication Nos. 47-33378/1972 and 44-9509/1969 in order to increase solubility of a developing agent.

In addition, various other additives such as antistaining agents, antisludging agents and developing accelerators may be added.

To the fixer of the invention may be added the conventional fixing agent. The fixing agent, a chelating agent, a pH buffering agent, a hardener, and a preservative can be added which are disclosed in Japanese Patent O.P.I. Publication Nos. 4-242246/1992 (page 4) and 5-113632/1993 (pages 2–4). Besides the above, chelating agents or bisulfite adducts of hardeners disclosed in Japanese Patent Application No. 4-586323/1992 (pages 20–21) or the well-known fixing accelerator are used as hardeners.

Before processing, starter is preferably added, and solidified starter is also preferably added. As starter, organic acids such as polycarboxylic acid compounds, alkali metal halides such as KBr, organic inhibitors and developing accelerators are used.

The sulfites in the invention include sodium sulfite, potassium sulfite, lithium sulfite, and ammonium sulfite. The water soluble ones are preferable, and sodium sulfite, potassium sulfite are especially preferable.

The sulfite concentration in the invention refers to that in the solution in which the solid processing composition is completely dissolved in a specific amount of diluting liquid.

The sulfite concentration of the developer used in the invention is preferably 0.3 mol/liter or more, and more preferably 0.45 mol/liter to 1.5 mol/liter.

The sulfite concentration of the fixer used in the invention is preferably 0.05 mol/liter or less, and more preferably 0.005 mol/liter to 0.03 mol/liter.

The replenishing amount of diluting liquid in the fixer of the invention is preferably 300 cc/m$^2$ or less, and more preferably 50 to 150 cc/m$^2$.

The diluting liquid referred to herein is a liquid replenished to the processing solution together with a solid processing composition, and preferably tap water. The liquid obtained by vaporizing waste solutions may be used.

That the sulfite content of the developer in the invention satisfies the following inequality means that the mol ratio of sodium sulfite to potassium sulfite in the solid developing composition of the invention satisfies the following inequality:

$$[(M_{Na})/(M_K)]>1$$

wherein $M_{Na}$ represents a mol number of sodium sulfite contained in 1 g of the solid developing composition; and $M_K$ represents a mol number of potassium sulfite contained in 1 g of the solid developing composition.

The silver halide photographic light sensitive material in the invention is not specifically limited, but the preferable will be described below.

An emulsion used for the silver halide photographic light sensitive material of the present invention can be produced by a conventional method. For example, a method described in Research Disclosure (RD) No. 17643 (December, 1978), pp. 22 to 23 "Emulsion Preparation and Types" or a method described in RD No. 18716 (November, 1979), on page 648 can be used for preparation. The emulsion of the present invention can be also prepared by a method described in "The Theory of the Photographic Process" 4th edition written by T. H. James, published by Macmillan Inc. (1979), pp. 38 to 104, a method described in "Photographic Emulsion Chemistry" written by G. F. Duffin, published by Focal Press Inc. (1966), a method described in "Chimie et Physique Photographique" written by P. Glafkides, published by Paul Montel Inc. (1967) or a method described in "Making And Coating Photographic Emulsion" written by V. L. Zelikman, published by Focal Press Inc. (1964) for preparation.

The preferably used silver halide emulsion is a type mono-dispersed emulsion having high iodide content inside disclosed in Japanese Patent OPI. Publication Nos. 177535/1984, 802237/1986, 132943/1986 and 49751/1988 and Japanese Patent Application No. 238225/1988. The crystal habit may be cubic, tetradecahedral, octahedral, or crystals having a (111) and (100) face.

The crystal structure of silver halide may be composed of a silver halide composition wherein inside and outside are different. The preferable emulsion is a core/shell type mono-dispersed emulsion having a two-layer structure wherein a core portion of high iodide content is covered with a shell layer of low iodide content. The silver iodide content in the high iodide content portion is 20 to 40 mol %, and preferably 20 to 30 mol %. This example is described in detail in J. Phot. Sci, 12.242 through 251 (1963), Japanese Patent OPI. Publication Nos. 36890/1973, 16364/1977, 142329/1980 and 49938/1983, British Patent No. 1,413,748, U.S. Pat. Nos. 3,574,628 and 3,655,394, British Patent No. 1,027,146, U.S. Pat. Nos. 3,505,068 and 4,444,877 and Japanese Patent OPI. Publication No. 14331/1985.

Another silver halide emulsion preferably used in the invention is tabular silver halide grains having an aspect ratio of 1 or more. Such tabular grains improve spectral sensitization efficiency, image graininess or image sharpness. These emulsions are prepared according to methods disclosed in British Patent No. 2,112,157, U.S. Pat. Nos. 4,439,520, 4,433,048, 4,414,319 and 4,434,226 and Japanese Patent OPI. Publication Nos. 113927/1983, 127921/1983, 138342/1988, 284272/1988 and 305343/1988.

Specifically, methods disclosed in Japanese Patent Application No. 289002/1992 (pages 1–3), Japanese Patent OPI. Publication No. 177535/1984 (pages 2–5), Japanese Patent Application No. 277369/1992 (pages 5–6), Japanese Patent OPI. Publication No. 42146/1987 (pages 14–15) are preferably used. Still another silver halide emulsion preferably used in the invention is silver bromochloride having a silver chloride content of 50% or more or silver chloride.

The silver halide emulsion has a silver iodide content of preferably not more than 0.5 mol %, and more preferably not more than 0.4 mol %, in that processing stability is not deteriorated.

The above-mentioned emulsion may be either of a surface latent image type wherein latent images are formed on the surface of grains, an inner latent image type wherein latent images are formed inside of the grains or a type wherein latent images are formed on the surface and inside of the grains. To these emulsion, at a step of physical ripening or of preparation of grains, for example, cadmium salt, lead salt, zinc salt, thalium salt, iridium salt or its complex salt, rhodium salt or its complex salt and iron salt or its complex salt may be added. In order to remove soluble salts from the emulsion, a noodle washing method and a floculation precipitation method can be used. The preferable washing methods include a method that uses an aromatic hydrocarbon aldehyde resin containing a sulfo group described in Japanese Patent Publication No. 16086/1960 or a desalting method that uses polymer coagulation agents illustrated G-3 and G-8 described in Japanese Patent OPI. Publication No. 158644/1988. In the chemical sensitization of the emulsion of the invention gold sensitization, sulfur sensitization, reduction sensitization and chalcogenide sensitization are carried out.

For the emulsion used in the silver halide photographic light sensitive material of the invention, various additives for photographic use can be used in a step before or after physical ripening or chemical ripening. Hydrazine compounds may be added. The compounds disclosed in Japanese Patent Application No. 5-134743/1993 are preferable and a compound represented by Formula (5) and a nulear accelerating compound represented by Formula (6) or (7) are especially preferable. Tetrazolium compounds may also be added. Besides, the compounds disclosed in Japanese Patent O.P.I. Publication No. 2-250050/1990 are preferable. The conventional additives include various compounds described in (RD) Nos. 17643 (December, 1978), 18716 (November, 1979) and 308119 (December, 1989) can be used. Locations where the compounds are described in these three (RD) are shown below:

| | RD-17643 | | RD-18716 | RD-308119 | |
|---|---|---|---|---|---|
| Additive | Page | Classification | Page | Page | Classification |
| Chemical Sensitizer | 23 | III | 648 upper right | 996 | III |
| Sensitizing Dye | 23 | IV | 648–649 | 996–8 | IV |
| Desensitizing Dye | 23 | IV | | 998 | B |
| Dye | 25–26 | VIII | 649–650 | 1003 | VIII |
| Development Accelerating Agent | 29 | XXI | 648 upper right | | |
| Anti-foggant Stabilizing Agent | 24 | IV | 649 upper right | 1006–7 | VI |
| Brightening Agent | 24 | V | | 998 | V |
| Hardener | 26 | X | 651 left | 1004–5 | X |
| Surfactant | 26–27 | XI | 650 right | 1005–6 | XI |
| Anti-static agent | 27 | XII | 650 right | 1006–7 | XIII |
| Plasticizer | 27 | XII | 650 right | 1006 | XII |
| Slipping Agent | 27 | XII | | | |
| Matting Agent | 28 | XVI | 650 right | 1008–9 | XVI |
| Binder | 26 | XXII | | 1003–4 | IX |
| Support | 28 | XVII | | 1009 | XVII |

The support used in the silver halide photographic light-sensitive material of the invention includes a support described on page 28 of RD-17643 and on page 1009 of RD-308119 above.

The suitable support includes a plastic film. In order to enhance adhesivity of the surface of the support to a coating layer, a subbing layer may be provided on the support or corona discharge and UV ray irradiation may be given to the surface. The cross-over cut layer or an anti-static layer may be also provided.

The silver amount coated in a light sensitive material is preferably not more than 3 g/m$^2$ in that processing stability is not deteriorated. The total gelatin content of a light sensitive material is preferably not more than 4 g/m$^2$, and more preferably not more than 3.6 g/m$^2$ in that processing stability is improved.

The silver halide emulsion layer can be coated on one or each side of the above obtained support. The emulsion layers provided on each side of the support may be the same as or different from each other.

FIG. 1 is a plan view showing an example of a processing apparatus used in the present invention. In the processing apparatus in FIG. 1, in both of a developing tank and a fixing tank, an anode and a cathode are partitioned each other by an anion-exchange membrane (A membrane) 26 and 36 and a cation-exchange membrane (K membrane) 25 and 35 so that they are structured by an anode room (N room) 24 and 34, a cathode room (A room) 21 and 31, one or more condensation room (C room) 22 and 32 and one or more desalting room (D room) 23 and 33.

First of all, liquid tank 20 will be explained. To the above-mentioned desalting room (D room) 23, waste of developing solution is circulated by means of pump 28. On the other hand, when an electrolytic solution such as sodium sulfate is circulated by means of pump 29 from the tank 27 to the anode room (N room) 24, the cathode room (A room) 21, and the condensation room (C room) 22, and an electric current flows across the anode and the cathode, halogenated ions in the waste are moved from the desalting room (D room) 23 to the condensation room (C room) 22 through anion-exchanging membrane 26 and removed. The halogenated ion collected to the condensation room (C room) 22 cannot pass cation-exchanging membrane (K membrane) 25 even though it wants to move to the cathode side. Therefore, it cannot move from the condensation room (C room) 22. Therefore, the halogenated ion can effectively be removed.

As shown in FIG. 1, the processing apparatus has developing tank 11 filled with developing solution 110, fixing tank 12 filled with fixing solution 120 and washing tank 13. It transports light-sensitive material 10 such as an X-ray film through each processing tank to provide each processing such as developing, fixing and washing.

In developing tank 11 and fixing tank 12, liquid tanks 20 and 30 in each of which liquid is circulated freely with each tank. In addition, in each of liquid tanks 20 and 30, anion-exchange membranes (A membrane) 26 and 36 are located in a manner that each tank is divided into two or more rooms.

Desalting room (D room) 23 is filled with developing solution 110. It is structured in a manner that liquid is communicated freely with a developing tank through a linkage tube. Condensation room (C room) in liquid tank 20 is filled with electrolyte solution 270. By the above-mentioned structure, developing solution 110 and electrolyte solution 270 are brought into contact through anion-exchanging membrane (A membrane). In anode room (N room) 24 in liquid tank 20, an anode is immersed. In cathode room (A room) 21 in liquid tank 20, a cathode is immersed.

Liquid tank 30 is the same as liquid tank 20. Desalting room (D room) is filled with fixing solution 120. Condensation room (C room) is filled with electrolyte 370 from tank 37. These are brought into contact through anion-exchanging membrane 36.

In addition, a processing apparatus wherein liquid tank 20 is composed only of an anode room (N room) and a cathode room (A room) can also be used. In this case, the anode room (N room) is filled with processing solution 110 and the cathode room (A room) is filled with electrolytic solution 270. The anode room (N room) and the cathode room (A room) are partitioned with an anion-exchange membrane (A membrane).

In addition, a processing apparatus wherein liquid tank 30 is composed only of an anode room (N room) and a cathode room (A room) can also be used. In this case, the anode room (N room) is filled with processing solution 120 and the cathode room (A room) is filled with electrolytic solution 370. The anode room (N room) and the cathode room (A room) are partitioned with an anion-exchanging membrane (A membrane).

By welding a halogenated substance ion in a processing solution, the halogenated substance ion passes through the anode room (N room) 24 and 34 and the anion-exchanging membrane to be moved to the cathode room (A room) 26 and 36 and removed.

For welding, voltage may be impressed in a manner that electric current density becomes 0.02 to 3 A/dm$^2$ and preferably 0.05 to 1.2 A/dm$^2$. Voltage to be impressed is completely different depending upon a solution used, form of the processing apparatus, distance between the electrodes and characteristics and kind of membrane. It is generally 0.05 to 100 V, and preferably 0.1 to 10 V.

In addition, the initial value of the membrane voltage is ordinarily 0.5 to 20 V (the membrane resistance is 0.5 to 30Ω).

By means of the above-mentioned welding during processing the light-sensitive material, halogenated substance ions such as $Br^-$ which are accumulated in the developing solution and the fixing solution due to processing can be moved to the other electrode through the anion-exchange membrane. Therefore, the halogenated substance ions in the processing solution can be kept constant. In addition, processing component of the developing agent oxidized is reduced so that processing ability is recovered. Thus, a certain processing performance can be obtained.

In the present invention, welding wherein electric current is constant is conducted. It this occasion, it may be controlled in a manner that the electric current per a unit voltage (for example, 1 l) of the processing solution (density of the electric current) becomes constant. When only welding (for example, fixed voltage, neither voltage nor electric current is controlled), an ampere-hour meter may be used for controlling. The reason for this is that, movement of the halogenated substance ion and oxidation in a bleaching solution affect on the amount of welding by 80 to 99%.

In this occasion, the density of electric current shall ordinarily be 0.5 to 50 A/l and preferably be 1 to 10 A/l. Due to this control, movement amount of anion ion can be controlled constantly.

In this occasion, electric amount necessary to recover developing power of the developing solution is different depending upon the adjustment of welding time. However, this electricity amount may be determined by the silver amount coated on the light-sensitive material and the amount of light-sensitive material carried over from the preceding bath.

Anything can be used for the anion-exchange membrane of the present invention, provided that it permeates anion selectively. Commercially available ones can be used as it is.

As the anion-exchange membrane, Selemion AMV/AMR (produced by Asahi Glass Co., Ltd.), Aciplex A201, A172 (producedby Asahi Kasei Co., Ltd.) and Nepton AR103PZL (produced by Ionics) can be used. However, since the object of the present invention is to permeate halogenated substance ion such as $Br^-$, it is preferable to use those which permeate mono-valent anion selectively such as Selmion ASV/ASR (produced by Asahi Glass Co., Ltd.), Neosepta AFN-7 and Neosepta ACS (produced by Tokuyama Soda).

Incidentally, in the present invention, the above-mentioned anion-exchange membrane is a general name of a membrane which permeates anions selectively. In this meaning, it includes a porous ceramics whose hole size is 0.2 to 20 μm.

In color photography practically, a processing solution used in the present invention includes a color developing solution, the first black-and-white developing solution for reverse processing and a fixing solution. In black-and-white photography, it includes a black-and-white developing solution and a fixing solution. In the above-mentioned processing solution, following the advancement of processing, it is necessary to prevent accumulation of the halogenated substance ions liquated out from the emulsion layer in the light-sensitive material.

On the other hand, a solution containing an electrolyte wherein a cathode is immersed may be a processing solution or one prepared separately. This one prepared separately is referred to as an electrolytic solution. As a processing solution, a processing solution having a bleaching ability such as a bleaching solution is cited. In the case of a bleaching solution, processing performance of the bleaching solution can be recovered by moving the halogenated ions from the developing solution and the fixing solution to the bleaching solution by combining the bleaching solution with the color developing solution and the fixing solution and by oxidizing the bleaching agent reduced with the cathode.

There is no limit to the electrolyte used for an electrolytic solution. However, it is preferable to use halogenated substances such as NaCl, KCl, LiCl, NaBr, KBr and KI, sulfate salts such as $Na_2SO_4$ and $K_2SO_4$, nitrate salts such as $KNO_3$, $NaNO_3$, $NH_4NO_3$ and carbonate salts such as $Na_2CO_3$ and $K_2CO_3$.

Of the above-mentioned various salts, when nitrate salts are used, nitric acid ion is replenished. Accordingly, replenishment of anti-corrosion agent and bleaching accelerator is decreased or, in some cases, they can be eliminated.

When sulfate salts are used, sulfate ion is replenished. Therefore, replenishment of acid for reducing pH can be decreased, or in some cases, eliminated.

When carbonate salts are used, carbonate ion is replenished. Therefore, replenishment of a pH buffer agent and acid can be decreased, or in some cases, eliminated.

Density of electrolyte in the electrolyte solution is ordinarily 0.1 to 30% and preferably 0.5 to 20%.

The anion-exchanging membrane may be appropriately selected depending the kind of electrolyte solution.

The anode used in the present invention may be any electroconductor or a semi-conductor capable of being used for a long time. Specifically, stainless is preferable. Anything can be used for the cathode provided that it is an insoluble material and an electricconductor. Practically, carbon (black lead), lead dioxide, platinum, gold and titanium steel are cited, and depending an opportunity, stainless steel may be used. Form of both electrodes are plate, plate provided with net or a plate provided with a projection are preferable. Size may be selected appropriately depending upon the volume of tank.

In the present invention, the amount of replenishing water for dissolving a solid processing agent charged is ordinarily 300 $cc/m^2$ or less and preferably 50 $cc/m^2$ to 150 $cc/m^2$.

In the present invention, processing speed of silver halide photographic light-sensitive material is ordinarily 20 $m^2/hr$ or more, and preferably 30 $m^2/hr$ to 100 $m^2/hr$.

EXAMPLES

The examples of the invention will be explained below, but the invention is not limited thereto.

Example 1

The light sensitive material for evaluation was prepared as follows.

(Preparation of Light Sensitive Material)

Preparation of Seed Emulsion-1

The seed emulsion-1 was prepared by the following method.

| | |
|---|---|
| A1 | |
| Ossein gelatin | 24.2 g |
| Water | 9657 ml |
| Polypropyleneoxy-polyethyleneoxy-disuccinate sodium salt (10% ethanol solution) | 6.78 ml |
| Potassium bromide | 10.8 g |
| 10% nitric acid | 114 ml |
| B1 | |
| Aqueous 2.5N $AgNO_3$ solution | 2825 ml |
| C1 | |
| Potassium bromide | 841 g |
| Water was added to make 2825 ml. | |
| <Solution D> | |
| Aqueous 1.75N KBr solution | an amount for controlling the following silver potential |

By the use of a mixing stirrer described in Japanese Patent Publication Nos. 58288/1983 and 58289/1982, 464.3 ml of each of Solution B1 and Solution C1 were added to Solution A1 in 1.5 minutes at 42° C. by a double-jet method to form a nuclei.

After addition of Solutions B1 and C1 was stopped, the temperature of Solution A1 was elevated to 60° C. spending 60 minutes and adjusted to pH 5.0 using a 3% KOH solution. Then, solutions B1 and C1 each were added by means of a double jet method for 42 minutes at a flow rate of 55.4 ml/min. The silver potentials (measured by means of a silver ion selecting electrode and a saturated silver-silver chloride reference electrode) during the temperature elevation from 42° to 60° C. and during the re-addition of solutions B1 and C1 were regulated to +8 mv and 16 mv, respectively, using Solution D1.

After the addition, pH was regulated to 6 with 3% KOH. Immediately after that, it was subjected to desalting and washing. It was observed by an electron microscope that this seed emulsion was composed of hexahedral tabular grains, in which 90% or more of the total projected area of silver halide grains have a maximum adjacent side ratio of 1.0 to 2.0, having an average thickness of 0.064 μm, an average diameter (converted to a circle) of 0.595 μm. The deviation coefficient of the thickness is 40%, and the deviation coefficient of the distance between the twin planes is 42%.

(Preparation of Em-1)

The tabular silver halide emulsion Em-1 was prepared using the seed emulsion-1 and the following four kinds of solutions.

| A2 | |
|---|---|
| Ossein gelatin | 34.03 g |
| Polypropyleneoxy-polyethyleneoxy-disuccinate sodium salt (10% ethanol solution) | 2.25 ml |
| Seed emulsion-1 | amount equivalent to 1.218 mol |
| Water was added to make 3150 ml. | |
| B2 | |
| Potassium bromide | 1734 g |
| Water was added to make 3644 ml. | |
| C2 | |
| Silver nitrate | 2478 g |
| Water was added to make 4165 ml. | |
| D2 | |
| *Fine gain emulsion composed of 3 weight % gelatin and silver iodide grains (averge grain size of 0.05 μ) | amount equivalent to 0.08 mol |

*Two liters of each of a 7.06 mol $AgNO_3$ solution and a 7.06 mol KI solution was added in 10 minutes to 6.64 liter of a 5.0 weight % gelatin solution containing 0.06 mol of KI. During the fine grain formation, the pH was adjusted to 2.0 using nitric acid, and the temperature was 40° C.. After the grain formation the pH was adjusted to 6.0 using a sodium carbonate solution.

A portion of Solution B2, a portion of Solution C2 and a half of Solution D2 were added to Solution A2 in 5 minutes at 60° C. by a triple-jet method with vigorous stirring. Thereafter, a half of each of the remaining solutions B2 and C2 was added in 37 minutes, then, a portion of the remaining solutions B2 and C2 and the remaining solution D2 were added in 15 minutes, and finally, all of the remaining solutions B2 and C2 were added in 33 minutes. During this process, pH was maintained 5.8, and pAg 8.8. Herein, the addition rate of solutions B2 and C2 was varied as a function of time to meet a critical grain growing rate.

Further, Solution D2 was added in an amount of 0.15 mol % of the total silver content to substitute a halogenide.

After the addition, the resulting emulsion was cooled to 40° C., added with 1800 ml of an aqueous 13.8 weight % solution of modified gelatin as a polymer coagulant, which was modified with phenylcarbamoyl (substitution rate of 90%), and stirred for 3 minutes. Thereafter, a 56 weight % acetic acid solution was added to give a pH of 4.6, stirred for 3 minutes, allowed to stand for 20 minutes, and then the supernant was decanted. Thereafter, 9.0 liter of 40° C. distilled water were added, stirred, allowed to stand, and the supernant was decanted. To the resulting emulsion were added 11.25 liter of distilled water, stirred, allowed to stand, and the supernant was decanted. An aqueous gelatin solution and a 10 weight % sodium carbonate solution were added to the resulting emulsion to be pH of 5.8, and stirred at 50° C. for 30 minutes to redisperse. After the redispersion, the emulsion was adjusted to give pH of 5.80 and pAg of 8.06.

When the resulting emulsion was observed by means of an electron microscope, they were tabular silver halide grains having an average diameter of 1.11 μm, an average thickness of 0.25 μm, an average aspect ratio of about 4.5 and a grain size distribution of 18.1%. The average distance between the twin planes was 0.020 μm, and the grains having 5 or more of a ratio of the distance to the thickness was 97% (in number), the grains having 10 or more of the ratio 49%, and the grains having 15 or more of the ratio 17%.

After the resulting emulsion (Em-1) was raised to 60° C., a spectral sensitizer was added in a specific amount in the form of a solid fine particle dispersion, and then a mixture solution of adenine, ammonium thiocyanate, chloroauric acid and sodium thiosulfate and a dispersion of triphenylphosphin selenide were added. Sixty minutes after the addition, the fine grain silver iodide emulsion was added, and the emulsion was ripened for total 2 hours. After completion of the ripening, 4-hydroxy-6-methyl-1,3,3a,7-tetrazaindene (TAI) was added for stabilizing.

The addition amount per mol of AgX of the above additives is shown as follows.

| | |
|---|---|
| 5,5'-Dichloro-9-ethyl-3,3'-di-(sodiumsulfopropyl)-oxacarbocianine anhydride | 2.0 mg |
| 5,5'-Di(butoxycarbonyl)-3,3'-di-(sodiumsulfobutyl)-benzoimidazolocarbocianine anhydride | 120 mg |
| Adenine | 15 mg |
| Ammonium thiocyanide | 95 mg |
| Chloroauric acid | 2.5 mg |
| Sodium thiosulfate | 2.0 mg |
| Triphenylphosphin selenide | 0.4 mg |
| Silver iodide fine grain emulsion | 280 mg |
| 4-Hydroxy-6-methyl-1,3,3a,7-tetrazaindene (TAI) | 500 mg |

The solid fine particle dispersion of the spectral sensitizing dye was prepared according to the method described in Japanese Patent Application No. 4-99437/1992. A specific amount of a spectral sensitizer was added to water at 27° C., and stirred at 3500 rpm for 30 to 120 minutes by means of a high speed stirrer (dissolver) to obtain a solid spectral sensitizing dye fine particle dispersion.

The above selenium sensitizer dispersion was prepared as follows. Triphenylphosphin selenide was added in an amount of 120 g to 30 kg of 30° C. ethyl acetate, and stirred to completely dissolve. Photographic gelatin in an amount of 3.8 kg was dissolved in 38 kg of pure water, and 93 g of a 25 wt % aqueous sodium dodecylbenzene sulfonate solution was added to obtain a gelatin solution. The above two solutions were mixed and dispersed at 50° C. for 30 minutes in 40m/second of a dispersion blade periodical speed, using a high speed stirring dispersion machine having a stirring blade of a 10 cm diameter. Thereafter, the ethyl acetate was removed to obtain a 0.3 wt % residual concentration of ethyl acetate while stirring under reduced pressure. The resulting dispersion was diluted with water to make a 80 kg dispersion. The above emulsion was prepared using a portion of this dispersion.

The silver halide grains contained in the above obtained silver halide emulsion (Em-1) had an average silver iodide content of 4 mol % on its surface. To the thus sensitized emulsion were added the following additives to obtain an emulsion layer coating solution. Further, a protective layer coating solution was prepared.

The above obtained emulsion layer coating solution and the following protective layer coating solution were double layer coated in that order on each side of a blue colored 175 μm thick polyethylene terephthalate film support (a density of 0.15) coated with the following light shieding layer on each side, and dried.

| First Layer (Light Shielding Layer) | |
|---|---|
| Solid dye fine particle dispersion (AH) | 180 $mg/m^2$ |
| Gelatin | 0.2 $g/m^2$ |
| Sodium dedecylbenzene sulfonate | 5 $mg/m^2$ |
| Compound (I) | 5 $mg/m^2$ |
| 2,4-Dichloro-6-hydroxy-1,3,5-triazine sodium salt | 5 $mg/m^2$ |
| Colloidal Silica (average diameter 0.014 μm) | 10 $mg/m^2$ |

-continued

Second Layer (Emulsion Layer)

Each emulsion obtained above was added with the following additives.

| | |
|---|---|
| Compound (G) | 0.5 mg/m$^2$ |
| 2,6-Bis(hydroxyamino)-4-diethylamino-1,3,5-triazine | 5 mg/m$^2$ |
| t-Butyl-catechol | 130 mg/m$^2$ |
| Polyvinyl pyrrolidone (molecular weight 10,000) | 35 mg/m$^2$ |
| Styrene-maleic acid anhydride copolymer | 80 mg/m$^2$ |
| Poly(sodium styrenesulfonate) | 80 mg/m$^2$ |
| Trimethylolpropane | 350 mg/m$^2$ |
| Diethylene glycol | 50 mg/m$^2$ |
| Nitrophenyl-triphenyl phosphonium chloride | 20 mg/m$^2$ |
| Ammonium 1,3-dihydroxybenzene-4-sulfonic acid | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Collodal Silica | 0.5 g/m$^2$ |
| Latex (L) | 0.2 g/m$^2$ |
| Dextrin (average molecular weight 1000) | 0.2 g/m$^2$ |
| Gelatin | 1.0 g/m$^2$ |

-continued

Third Layer (Protective Layer)

| | |
|---|---|
| Gelatin | 0.8 g/m$^2$ |
| Polymethylmethacrylate matting agent having an area average grain size of 7 μm) | 50 mg/m$^2$ |
| Hormaldehyde | 20 mg/m$^2$ |
| 2,4-Dichloro-6-hydroxy-1,3,5-triazine sodium salt | 10 mg/m$^2$ |
| Bis-vinylsulfonylmethyl ether | 36 mg/m$^2$ |
| Latex (L) | 0.2 g/m$^2$ |
| Polyacrylamide (molecular weight 10,000) | 0.1 g/m$^2$ |
| Polysodium acrylate | 30 mg/m$^2$ |
| Polysiloxane (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| $C_9H_{19}$-O-$(CH_2CH_2O)_{11}$-H | 3 mg/m$^2$ |
| $C_8F_{17}SO_2N(C_3H_7)[(CH_2CH_2O)_{15}H]$ | 2 mg/m$^2$ |
| $C_8F_{17}SO_2N(C_3H_7)[(CH_2CH_2O)_4$-$(CH_2)_4SO_3Na]$ | 1 mg/m$^2$ |

The amount was per one side of the support, and the silver amount was 1.6 g/m$^2$ per one side of the support.

Compound (G)

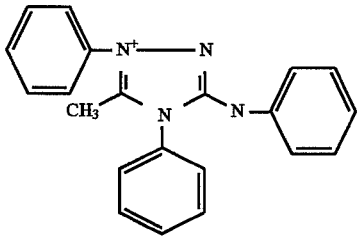

Compound (H)

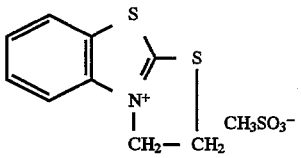

Compound (I)

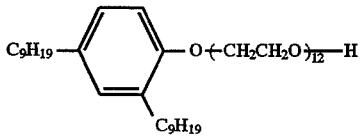

Compound (J)

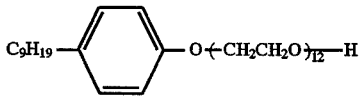

Compound (K)

-continued

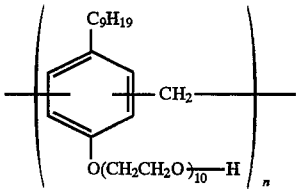

(n = mixture of 2–5)

Compound (S-1)

$NaO_3S-CH(CH_2COO(CH_2)_9CH_3)COO(CH_2)_2CH(CH_3)_2$

Compound (S-2)

$NaO_3S-CH(CH_2COOCH_2(C_2F_4)_3H)COOCH_2(C_2F_4)_3H$

Latex (L)

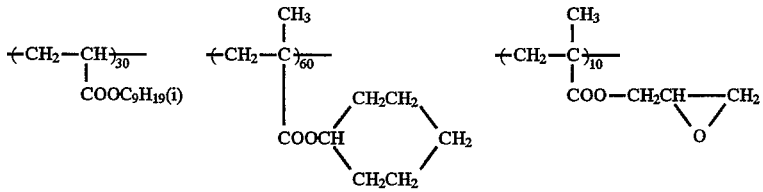

Polysiloxane (SI)

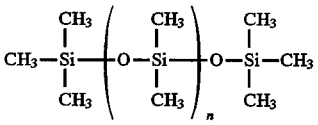

n ≈ 1000

Solid fine particle dispersion dye (AH)

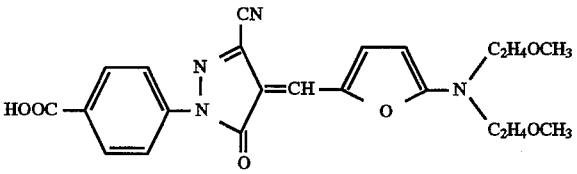

Compound (O)

$C_{11}H_{23}CONH(CH_2CH_2O)_5H$

Compound (M)

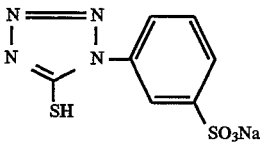

Compound (N)

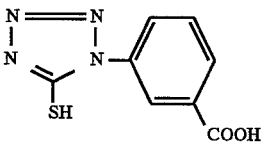

<<Preparation of Processing Tablets>>

A tablet developer replenisher was prepared in the following procedures (A) and (B).

Procedure (A)

In a bandam mill available on the market was pulverized 3000 g of hydroquinone, a developing agent to an average particle size of 10 μm. The resulting fine particles were added with sodium thiosulfate and potassium sulfite in an amount as shown in Table 1 and 1,000 g of dimeson S and mixed in a mill for 30 minutes. The resulting mixture was granulated by adding 30 ml of water at room temperature for about 10 minutes in a stirring granulator available on the market and dried at 40° C. for 2 hours in a fluid-bed drier to almost completely remove water. The resulting granules were uniformly mixed in a mixer with 100 g of polyethylene glycol 6000 at 25° C. and 40%RH or less, and the mixture was compression-tableted in an amount per tablet as shown in Table 1, using Tough Press Correct Model 1527HU produced by Kikusui Seisakusho Co., Ltd., which was modified. Thus, 2,500 tablets of each of developer replenishers A-1 through A-6 were obtained.

Procedure (B)

DTPA of 100 g, 4000 g of potassium carbonate, 10 g of 5-methylbenzotriazole, 7 g of 1-phenyl-5-mercaptotetrazole, 5 g of 2-mercaptohypoxantine, 500 g of KOH and N-acetyl-D,L-penicilamine were pulverized and granulated in the same manner as in Procedure (A). The addition amount of water was 30.0 ml. After the granulation, the granules were dried at 50° C. for 30 minutes to almost completely remove water. The resulting mixture was compression-tableted in an amount per tablet of 1.73 g, using Tough Press Correct Model 1527HU produced by Kikusui Seisakusho Co., Ltd., which was modified. Thus, 2,500 tablets of developer replenisher B were obtained.

A tablet fixer replenisher was prepared in the following procedures.

Procedure (C)

Ammonium thiosulfate/sodium thiosulfate (70/30, weight ratio) of 14,000 g and sodium sulfite in an amount shown in Table 2 were pulverized and mixed in a mixer available on the market. The resulting mixture was granulated by adding 500 ml of water in the same manner as in Procedure (A). After the granulation, the granules were dried at 60° C. for 30 minutes to almost completely remove water. The resulting granules were mixed with 4 g of sodium N-lauroylalanine in a commercial mixer at 25° C. and 40%RH or less for 3 minutes and compression-tableted in an amount per tablet as shown in Table 2, using Tough Press Correct Model 1527HU produced by Kikusui Seisakusho Co., Ltd., which was modified. Thus, 2,500 tablets of each of fixer replenishers C-1 through C-4 were obtained.

Procedure (D)

Boric acid of 1000 g, 1500 g of aluminium sulfate octadecahydrate, 3000 g of sodium hydrogen acetate (obtained by mixing and drying an equimolucular glacial acetic acid and sodium acetate) and 200 g of tartaric acid were pulverized and granulated in the same manner as in Procedure (A). The addition amount of water was 100 ml. After the granulation, the granules were dried at 50° C. for 30 minutes to almost completely remove water. The resulting granules were mixed with 4 g of sodium N-lauroylalanine for 3 minutes and compression-tableted in an amount per tablet of 4.562 g, using Tough Press Correct Model 1527HU produced by Kikusui Seisakusho Co., Ltd., which was modified. Thus, 1,250 tablets of fixer replenisher D were obtained.

Developer Starter

| | |
|---|---|
| Glacial acetic acid | 2.98 g |
| KBr | 4.0 g |

Water was added to make 1 liter.

The tablet developer was dissolved in diluting water to make a 16.5 liter developing solution and 330 ml of the starter was added thereto to prepare a developing starting solution. The developer tank was charged with the starting solution at the beginning of processing. The pH of the starting solution was 10.45.

The fixer starting solution was prepared according to the following method. The fixer tank was charged with the fixer starting solution at the beginning of processing and the processing was carried out.

Prescription of Fixer

| | |
|---|---|
| Part A (for 18 liter) | |
| Ammonium thiosulfate (70 wt/vol %) | 6000 g |
| Sodium sulfite | 110 g |
| Sodium acetate trihydrate | 450 g |
| Sodium citrate | 50 g |
| Gluconic acid | 70 g |
| 1-(N,N-dimethylamino)-ethyl-5-mercaptotetrazole | 18 g |
| Part B | |
| Aluminium sulfate | 800 g |

Part A and Part B were added simultaneously to about 5 liter water and additional water was added with stirring to make a 18 liter solution. The pH was adjusted to pH 4.4 using surfuric acid and NaOH.

The above obtained light sensitive material was exposed to give a density of 1.0 after development and 2000 sheets of the material having a size of 10×12 inch$^2$ were running processed. The processing was carried out using an automatic processor, SRX-502 (produced by Konica Corporation), which was equipped with an incorporating member of solid tablet and modified so that 45 second processing could be conducted.

During the processing two tablets of the developer replenisher A, two tablets of the developer replenisher B and 76 ml water were added to a developer per 0.62 m$^2$ of light sensitive material. When tablets A and B were dissolved in 38 ml water, respectively, the pH of each solution was 10.70, and when two tablets of the developer replenisher A and two tablets of the developer replenisher B were dissolved in 76 ml water, the sulfite concentration in the solution was shown in Table 1. The fixer replenishers C and D, and water in an amount shown in Table 3 were added to a fixer. Two tablets of the fixer replenisher C and one tablet of the fixer replenisher D were added per addition of 74 ml water. When two tablets of the fixer replenisher C and one tablet of the fixer replenisher D were dissolved in 74 ml water, the sulfite concentration in the solution was shown in Table 2.

Water was added at the same time as the addition of each one tablet and the adding speed of water was almost in a proportion to the dissolving speed of each one tablet added.

Processing Conditions

| | | |
|---|---|---|
| Development | 35° C. | 8.2 seconds |
| Fixing | 33° C. | 5 seconds |
| Washing | Room Temp. | 4.5 seconds |
| Squeezing | | 1.6 seconds |
| Drying | 40° C. | 5.7 seconds |
| Total | | 25 seconds |

<<Evaluation>>

<Evaluation of Fixibility>

The resulting running fixer was evaluated for time giving transparency of the solution (clearing time). The fixer temperature was 25° C.

<Evaluation of drying>

Light sensitive material was processed using the resulting running solutions and taken out after developing, fixing, washing and squeezing. The resulting material was dried using a commercial drier and the time the surface temperature of the material reached 30° C. was measured by means of a surface thermometor.

The results are shown in table 3.

TABLE 1

| Processing tablet No. | Sodium Sulfite (g) | Potassium Sulfite (g) | Weight per Tablet (g) | Concentration of Sodium Sulfite (mol/liter) | $M_{Na}/M_K$ |
|---|---|---|---|---|---|
| A-1 | 5042 | 3162 | 5.12 | 0.6 | 2 |
| A-2 | 3781 | 2374 | 4.3 | 0.45 | 2 |
| A-3 | 2101 | 1319 | 3.21 | 0.25 | 2 |
| A-4 | 1260 | 791 | 2.66 | 0.15 | 2 |
| A-5 | 4254 | 1780 | 4.25 | 0.45 | 3 |
| A-6 | 2335 | 4189 | 4.45 | 0.45 | 0.7 |

TABLE 2

| Processing tablet No. | Sodium Sulfite (g) | Weight per Tablet (g) | Concentration of Sodium Sulfite (mol/liter) |
|---|---|---|---|
| C-1 | 126 | 5.652 | 0.01 |
| C-2 | 630 | 5.854 | 0.05 |
| C-3 | 1260 | 6.106 | 0.1 |
| C-4 | 0 | 5.602 | 0 |

TABLE 3

| | Developer | | | Fixer | | | | | |
|---|---|---|---|---|---|---|---|---|---|
| | | | | | | Replenishing | | | |
| No. | Processing tablet No. | Sodium Sulfite (mol/liter) | Na/K | Processing tablet No. | Sodium Sulfite (mol/liter) | Amount of Water (cc/m$^2$) | Fixibility, Clearing Time (sec) | Drying Property (sec) | Remarks |
| 1 | A-1 | 0.6 | 2 | C-1 | 0.01 | 120 | 4.5 | 21 | Inv. |
| 2 | A-2 | 0.45 | 2 | C-1 | 0.01 | 120 | 5.0 | 21 | Inv. |
| 3 | A-3 | 0.25 | 2 | C-1 | 0.01 | 120 | 7.0 | 21 | Inv. |
| 4 | A-4 | 0.15 | 2 | C-1 | 0.01 | 120 | 9.5 | 21 | Inv. |
| 5 | A-5 | 0.45 | 3 | C-1 | 0.01 | 120 | 4.5 | 21 | Inv. |
| 6 | A-2 | 0.45 | 2 | C-1 | 0.01 | 120 | 5.0 | 21 | Inv. |
| 7 | A-6 | 0.45 | 0.7 | C-1 | 0.01 | 120 | 7.0 | 21 | Inv. |
| 8 | A-2 | 0.45 | 2 | C-3 | 0.1 | 120 | 4.5 | 30 | Comp. |
| 9 | A-2 | 0.45 | 2 | C-2 | 0.05 | 120 | 5.0 | 24 | Inv. |
| 10 | A-2 | 0.45 | 2 | C-1 | 0.01 | 120 | 5.0 | 21 | Inv. |
| 11 | A-2 | 0.45 | 2 | C-4 | 0 | 120 | 4.5 | 19 | Inv. |
| 12 | A-2 | 0.45 | 2 | C-1 | 0.01 | 360 | 8.0 | 21 | Inv. |
| 13 | A-2 | 0.45 | 2 | C-1 | 0.01 | 240 | 6.0 | 21 | Inv. |
| 14 | A-2 | 0.45 | 2 | C-1 | 0.01 | 120 | 5.0 | 21 | Inv. |

Inv.: Invention
Comp.: Comparative

As is apparent from Table 3, the fixibility and drying property were improved according to the invention. The effects of the invention was remarkable especially when a sulfite ion was removed from the fixer. Further, the reduction of water replenishing amount for the fixer was also effective.

Example 2

The comparative tests were carried out for evaluation of precipitations or fixing ability after storage, using the fixer starting solution of Example 1 and fixer A according to the following method.

Prescription of Fixer

| | |
|---|---|
| Part A (for 18 liter) | |
| Ammonium thiosulfate (70 wt/vol %) | 6000 g |
| Sodium acetate trihydrate | 450 g |
| Sodium citrate | 50 g |
| Gluconic acid | 70 g |
| 1-(N,N-dimethylamino)-ethyl-5-mercaptotetrazole | 18 g |
| Part B | |
| Aluminium sulfate | 800 g |

Part A and Part B were added simultaneously to about 5 liter water and additional water was added with stirring to make a 18 liter solution. The pH was adjusted to pH 4.4 using surfuric acid and NaOH.

The fixer starting solution, fixer and running solution (No. 2 of Table 3 in Example 1) were allowed to stand at 34° C. for 15 days and evaluated.

<Evaluation of Precipitations>

Precipitations were observed with the following criteria:

1: No precipitations

2: Slight precipitations

3: A large amount of precipitations

<Evaluation of fixibility>

The fixibility was evaluated for time giving transparency of the solution (clearing time) in the same manner as in Example 1. The processing was carried out in the same manner as in Example 1. The fixer temperature was 25° C.

The results are shown in Table 4.

TABLE 4

| No. | Fixer | Precipitations | Fixibility, Clearing Time (sec) Fresh Solution | Stored Solution | Remarks |
|---|---|---|---|---|---|
| 1 | Fixer Starting Solution | 1 | 3.5 | 4 | Invention |
| 2 | Fixer A | 3 | 4 | 8 | Comparative |
| 3 | Running Solution | 1 | 5 | 5.5 | Invention |

As is apparent from Table 4, the fixibility of the fixers at the beginning of processing or after storage was improved according to the invention.

Example 3

(Preparation of Silver Halide Emulsion B)

A silver halide emulsion was prepared in a double-jet precipitation method. In the process hexachloro rhodium complex was added in an amount of $8\times10^{-8}$ mol/mol of silver. After the conventional desalting, the resulting emulsion was proved to be an emulsion comprising cubic monodisperse grains containing 99 mol % of silver chloride and 1 mol % of silver bromide and having an average particle diameter of 0.10 μm (with a variation coefficient of 10%).

To the resulting emulsion was added 4-hydroxy-6-methyl-1,3,3a,7-tetrazaindene, potassium bromide, citric acid and $3\times10^{-6}$ mol/mol of silver of an inorganic sulfur and chemically ripened at 60° C. to give the maximum density. After the ripening, 4-hydroxy-6-methyl-1,3,3a,7-tetrazaindene, $3\times10^{-4}$ mol per mol of silver of 1-phenyl-5-mercaptotetrazole and gelatin were added to obtain silver halide emulsion B.

(Preparation of Silver Halide Photographic Light-Sensitive Material)

A 75 μm thick polyethylene terephthalate film subjected to anti-static treatment in the same manner as in Example 1 of Japanese Patent O.P.I. Publication No. 3-92175/1991 was simultaneously multi-layer coated on the subbing layer on one side with the gelatin subbing composition of the following prescription 7 to give a gelatin content of 0.5 g/m², the silver halide emulsion of the following prescription 8 on the gelatin subbing layer to give a silver content of 2.5 g/m² and a gelatin content of 1.0 g/m², and further with a protective composition of the following prescription 9 on the emulsion layer to give a gelatin content of 0.4 g/m². The subbing layer on the other side of the film was simultaneously multi-layer coated the backing layer composition of the following prescription 10 to give a gelatin content of 0.4 g/m², the polymer layer composition of the following prescription 11 on the backing layer, and the backing protective layer composition of the following prescription 11 on the polymer layer to give a gelatin content of 0.4 g/m².

| Prescription 7 (Gelatin subbing composition) | |
|---|---|
| Gelatin | 0.5 g/m² |
| Dye b (pulverized to a particle size of 0.01 μm by a ball mill dispersion) | 20 mg/m² |
| Dye c (pulverized to a particle size of 0.01 μm by a ball mill dispersion) | 10 mg/m² |
| Dye 1 (pulverized to a particle size of 0.01 μm by a ball mill dispersion) | 80 mg/m² |
| Hydrophilic styrene-maleic acid copolymer (thickner) | 10 mg/m² |
| S-1 (sodium isoamyl-n-decyl-sulfosuccinate | 0.4 mg/m² |
| **Prescription 8 (Silver halide emulsion composition)** | |
| Tetrazolium compound T-5 | 30 mg/m² |
| Sodium dodecylbenzene sulfonate | 10 mg/m² |
| 5-methylbenzotriazole | 10 mg/m² |
| Compound m | 6 mg/m² |
| Latex polymer f | 1.0 g/m² |
| Hardener g | 40 mg/m² |
| S-1 | 0.7 mg/m² |
| Hydrophilic styrene-maleic acid copolymer (thickner) | 20 mg/m² |
| **Prescription 9 (Emulsion protective layer composition)** | |
| Gelatin | 0.5 g/m² |
| Dye c (pulverized to a particle size | 100 mg/m² |
| S-1 | 12 mg/m² |
| Matting agent (monodisperse silica of an average particle size of 3.0 μm) | 15 mg/m² |
| Matting agent (monodisperse silica of an average particle size of 8.0 μm) | 20 mg/m² |
| 1,3-vinylsulfonyl-2-propanol | 50 mg/m² |
| Surfactant h | 1 mg/m² |
| Colloidal silica of an average particle size of 0.05 μm) | 20 mg/m² |
| **Prescription 10 (Backing layer composition)** | |
| Gelatin | 0.4 g/m² |
| S-1 | 5 mg/m² |
| Latex polymer f | 0.3 g/m² |
| Colloidal silica of an average particle size of 0.05 μm) | 70 mg/m² |
| Hydrophilic styrene-maleic acid copolymer (thickner) | 20 mg/m² |
| Compound i | 100 mg/m² |
| **Prescription 11 (Polymer layer composition)** | 1.0 g/m² |
| Latex n (styrene:butadiene:acrylic acid = 30:65:5) | 1.0 g/m² |
| Hardener g | 10 mg/m² |
| **Prescription 12 (Backing protective layer composition)** | |
| Gelatin | 0.4 g/m² |
| Matting agent (monodisperse polymethyl methacrylate of an average particle size of 5 μm) | 50 mg/m² |
| Sodium di-(2-ethylhexyl)-sulfosuccinate | 10 mg/m² |
| Surfactant h | 1 mg/m² |
| $H-(OCH_2CH_2)_{68}OH$ | 50 mg/m² |
| Hardener g | 40 mg/m² |

Dye b

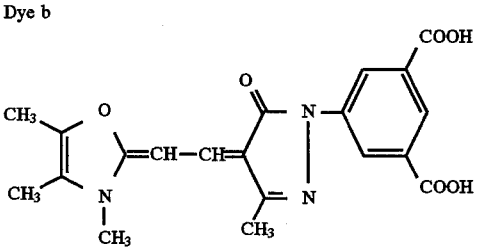

-continued

Dye c

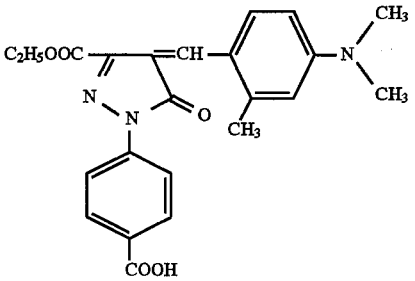

Compound i

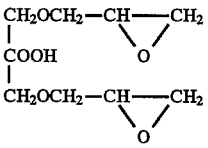

Latex polymer f

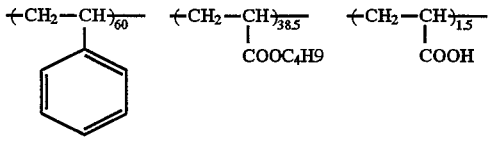

Hardener g

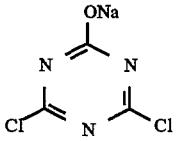

Surfactant h

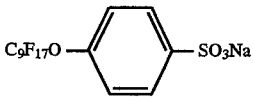

Dye 1

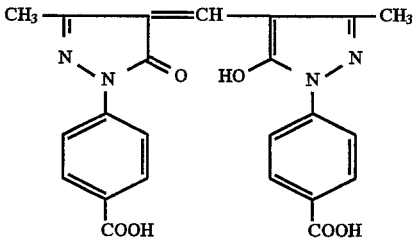

-continued

Compound m

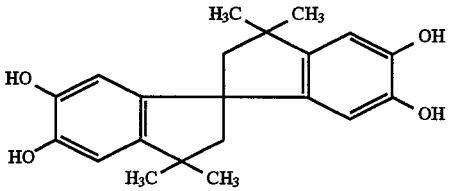

T-5

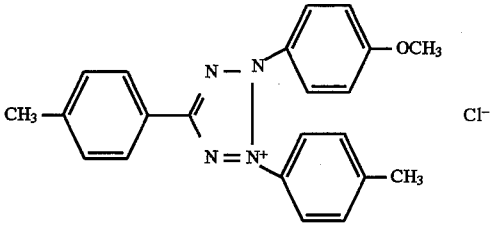

The above obtained light sensitive material was processed and evaluated for fixibility and drying property in the same manner as in Example 1, except that an automatic processor, GR26SR (produced by Konica Corporation), which was connected with an incorporating tank of replenishing tablet and a nozzle for replenishing water, was used.

The proccessing time was as follows:

Processing Conditions

| | | |
|---|---|---|
| Development | 35° C. | 8.2 seconds |
| Fixing | 33° C. | 5 seconds |
| Washing | Room Temp. | 4.5 seconds |
| Squeezing | | 1.6 seconds |
| Drying | 40° C. | 5.7 seconds |
| Total | | 25 seconds |

TABLE 5

| | Developer | | | Fixer | | | | | |
|---|---|---|---|---|---|---|---|---|---|
| No. | Processing tablet No. | Sodium Sulfite (mol/liter) | Na/K | Processing tablet No. | Sodium Sulfite (mol/liter) | Replenishing Amount of Water (cc/m$^2$) | Fixibility, Clearing Time (sec) | Drying Property (sec) | Remarks |
| 1 | A-1 | 0.6 | 2 | C-1 | 0.01 | 120 | 5.5 | 19 | Inv. |
| 2 | A-2 | 0.45 | 2 | C-1 | 0.01 | 120 | 6.0 | 19 | Inv. |
| 3 | A-3 | 0.25 | 2 | C-1 | 0.01 | 120 | 8.0 | 19 | Inv. |
| 4 | A-4 | 0.15 | 2 | C-1 | 0.01 | 120 | 10.5 | 19 | Inv. |
| 5 | A-5 | 0.45 | 3 | C-1 | 0.01 | 120 | 5.5 | 19 | Inv. |
| 6 | A-2 | 0.45 | 2 | C-1 | 0.01 | 120 | 6.0 | 19 | Inv. |
| 7 | A-6 | 0.45 | 0.7 | C-1 | 0.01 | 120 | 8.0 | 19 | Inv. |
| 8 | A-2 | 0.45 | 2 | C-3 | 0.1 | 120 | 5.5 | 28 | Comp. |
| 9 | A-2 | 0.45 | 2 | C-2 | 0.05 | 120 | 6.0 | 22 | Inv. |
| 10 | A-2 | 0.45 | 2 | C-1 | 0.01 | 120 | 6.0 | 21 | Inv. |
| 11 | A-2 | 0.45 | 2 | C-4 | 0 | 120 | 5.5 | 17 | Inv. |
| 12 | A-2 | 0.45 | 2 | C-1 | 0.01 | 360 | 9.0 | 19 | Inv. |
| 13 | A-2 | 0.45 | 2 | C-1 | 0.01 | 240 | 7.0 | 19 | Inv. |
| 14 | A-2 | 0.45 | 2 | C-1 | 0.01 | 120 | 6.0 | 19 | Inv. |

Inv.: Invention
Comp.: Comparative

As is apparent from Table 5, the fixibility and drying property were improved according to the invention. The effects of the invention was remarkable especially when a sulfite ion was removed from the fixer. Further, the reduction of water replenishing amount for the fixer was also effective.

Example 4

The light sensitive material prepared in Example 1 was processed in the same manner as in sample No. 9 of Example 1, except that automatic processor SRX-502 (produced by Konica Corporation) which was modified to be equipped with MICRO ACILYZER G3 (produced by Asahi Kasei Kogyo Co., Ltd.) was used. The MICRO ACILYZER G3 is a device removing an ion from a solution through electrification. The dissolving speed or solubility of the tablets, sensitivity and residual silver were evaluated. The residual silver refers to silver remained in the unexposed portions of the developed light sensitive material. The results exhibited improved dissolving speed or solubility, higher sensitivity and lower residual silver as compared with those obtained when an automatic processor without MICRO ACILYZER G3 was used.

Example 5

Preparation of Light Sensitive Material

Preparation of Seed Emulsion-21

The seed emulsion-21 was prepared as follows.

| | |
|---|---|
| A21 | |
| Ossein gelatin | 24.2 g |
| Water | 9657 ml |
| Polypropyleneoxy-polyethyleneoxy-disuccinate sodium salt (10% ethanol solution) | 6.78 ml |
| Potassium bromide | 10.8 g |
| 10% nitric acid | 114 ml |
| B21 | |
| Aqueous 2.5N $AgNO_3$ solution | 2825 ml |

-continued

| | |
|---|---|
| C21 | |
| Potassium bromide | 841 g |
| Water was added to make 2825 ml. | |
| D21 | |
| Aqueous 1.75N KBr solution | an amount for controlling the following silver potential |

By the use of a mixing stirrer described in Japanese Patent Publication Nos. 58288/1983 and 58289/1982, 464.3 ml of each of Solution B21 and Solution C21 were added to Solution A21 in 1.5 minutes at 42° C. by a double-jet method to form a nuclei.

After addition of Solutions B21 and C21 was stopped, the temperature of Solution A21 was elevated to 60° C. spending 60 minutes and adjusted to pH 5.0 using a 3% KOH solution. Then, solutions B21 and C21 each were added by means of a double jet method for 42 minutes at a flow rate of 55.4 ml/min. The silver potentials (measured by means of a silver ion selecting electrode and a saturated silver-silver chloride reference electrode) during the temperature elevation from 42° to 60° C. and during the re-addition of solutions B21 and C21 were regulated to +8 mv and 16 mv, respectively, using Solution D21.

After the addition, pH was regulated to 6 with 3% KOH. Immediately after that, it was subjected to desalting and washing. It was observed by an electron microscope that this seed emulsion was composed of hexahedral tabular grains, in which 90% or more of the total projected area of silver halide grains have a maximum adjacent side ratio of 1.0 to 2.0, having an average thickness of 0.064 μm, an average diameter (converted to a circle) of 0.595 μm. The deviation coefficient of the thickness is 40%, and the deviation coefficient of the distance between the twin planes is 42%.

(Preparation of Em-21)

The tabular silver halide emulsion Em-21 was prepared using the seed emulsion-21 and the following four kinds of solutions.

| A22 | |
|---|---|
| Ossein gelatin | 34.03 g |
| Polypropyleneoxy-polyethyleneoxy-disuccinate sodium salt (10% ethanol solution) | 2.25 ml |
| Seed emulsion-1 | amount equivalent to 1.218 mol |
| Water was added to make 3150 ml. | |
| B22 | |
| Potassium bromide | 1734 g |
| Water was added to make 3644 ml. | |
| C22 | |
| Silver nitrate | 2478 g |
| Water was added to make 4165 ml. | |
| D22 | |
| *Fine gain emulsion composed of 3 weight % gelatin and silver iodide grains (average grain size of 0.05 μ) | |

*Two liters of each of a 7.06 mol $AgNO_3$ solution and a 7.06 mol KI solution was added in 10 minutes to 6.64 liter of a 5.0 weight % gelatin solution containing 0.06 mol of KI. During the fine grain formation, the pH was adjusted to 2.0 using nitric acid, and the temperature was 40° C. After the grain formation the pH was adjusted to 6.0 using a sodium carbonate solution.

A portion of Solution B22, a portion of Solution C22 and a half of Solution D22 were added to Solution A22 in 5 minutes at 60° C. by a triple-jet method with vigorous stirring. Thereafter, a half of each of the remaining solutions B22 and C22 was added in 37 minutes, then, a portion of the remaining solutions B22 and C22 and the remaining solution D22 were added in 15 minutes, and finally, all of the remaining solutions B22 and C22 were added in 33 minutes. During this process, pH was maintained 5.8, and pAg 8.8. Herein, the addition rate of solutions B22 and C22 was varied as a function of time to meet a critical grain growing rate.

Solution D22 was added to give a halogen composition as shown in Table 6.

After the addition, the resulting emulsion was cooled to 40° C., added with 1800 ml of an aqueous 13.8 weight % solution of modified gelatin as a polymer coagulant, which was modified with phenylcarbamoyl (substitution rate of 90%), and stirred for 3 minutes. Thereafter, a 56 weight % acetic acid solution was added to give a pH of 4.6, stirred for 3 minutes, allowed to stand for 20 minutes, and then the supernant was decanted. Thereafter, 9.0 liter of 40° C. distilled water were added, stirred, allowed to stand, and the supernant was decanted. To the resulting emulsion were added 11.25 liter of distilled water, stirred, allowed to stand, and the supernant was decanted. An aqueous gelatin solution and a 10 weight % sodium carbonate solution were added to the resulting emulsion to be pH of 5.8, and stirred at 50° C. for 30 minutes to redisperse. After the redispersion, the emulsion was adjusted to give pH of 5.80 and pAg of 8.06.

When the resulting emulsion was observed by means of an electron microscope, they were tabular silver halide grains having an average diameter of 0.91 μm, an average thickness of 0.20 μm, an average aspect ratio of about 4.5 and a grain size distribution of 18.1%. The average distance between the twin planes was 0.020 μm, and the grains having 5 or more of a ratio of the distance to the thickness was 97% (in number), the grains having 10 or more of the ratio 49%, and the grains having 15 or more of the ratio 17%.

After the resulting emulsion (Em-21) was raised to 60° C., a spectral sensitizer was added in a specific amount in the form of a solid fine particle dispersion, and then a mixture solution of adenine, ammonium thiocyanate, chloroauric acid and sodium thiosulfate and a dispersion of triphenylphosphin selenide were added. Sixty minutes after the addition, the fine grain silver iodide emulsion (in an amount of 0.3 mol % in terms of halogen composition) was added, and the emulsion was ripened for total 2 hours. After completion of the ripening, 4-hydroxy-6-methyl-1,3,3a,7-tetrazaindene was added for stabilizing.

The addition amount per mol of AgX of the above described additives is shown as follows.

| | |
|---|---|
| Spectral Sensitizer (I) | 2.0 mg |
| Spectral Sensitizer (II) | 120 mg |
| Adenine | 15 mg |
| Potassium thiocyanide | 95 mg |
| Chloroauric acid | 2.5 mg |
| Sodium thiosulfate | 2.0 mg |
| Triphenylphosphin selenide | 0.4 mg |
| 4-Hydroxy-6-methyl-1,3,3a,7-tetrazaindene | 2000 mg |

Spectral Sensitizer (I)

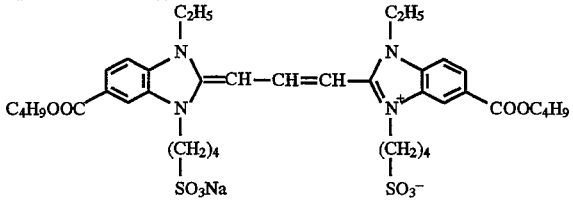

Spectral Sensitizer (II)

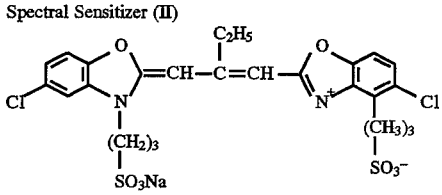

The solid fine particle dispersion of the spectral sensitizing dye was prepared according to the method described in Japanese Patent Application No. 4-99437/1992. A specific amount of a spectral sensitizer was added to water at 27° C., and stirred at 3500 rpm for 30 to 120 minutes by means of a high speed stirrer (dissolver) to obtain a solid spectral sensitizing dye fine particle dispersion.

The above selenium sensitizer dispersion was prepared as follows. Triphenylphosphin selenide was added in an amount of 120 g to 30 kg of 30° C. ethyl acetate, and stirred to completely dissolve. Photographic gelatin in an amount of 3.8 kg was dissolved in 38 kg of pure water, and 95 g of a 25 wt % aqueous sodium dodecylbenzene sulfonate solution was added to obtain a gelatin solution. The above two solutions were mixed and dispersed at 50° C. for 30 minutes in 40m/second of a dispersion blade periodical speed, using a high speed stirring dispersion machine having a stirring blade of a 10 cm diameter. Thereafter, the ethyl acetate was removed to obtain a 0.3 wt % residual concentration of ethyl acetate while stirring under reduced pressure. The resulting dispersion was diluted with water to make a 80 kg dispersion. The above emulsion was prepared using a portion of this dispersion.

To the thus sensitized emulsion were added the following additives to obtain an emulsion layer coating solution. Further, a protective layer coating solution was prepared.

The above obtained emulsion layer coating solution and the following protective layer coating solution were double layer coated in that order on each side of a blue colored 175 μm thick polyethylene terephthalate film support (a density of 0.15) coated with the following light shielding layer on each side, and dried.

| First Layer (Light Shielding Layer) | |
|---|---|
| Solid dye fine particle dispersion (AH) | 180 mg/m$^2$ |
| Gelatin | 0.15 g/m$^2$ |
| Sodium dedecylbenzene sulfonate | 5 mg/m$^2$ |
| Compound (I) | 5 mg/m$^2$ |
| 2,4-Dichloro-6-hydroxy-1,3,5-triazine sodium salt | 5 mg/m$^2$ |
| Colloidal Silica (average diameter 0.014 μm) | 10 mg/m$^2$ |
| Second Layer (Emulsion Layer) | |

-continued

| | |
|---|---|
| Hormaldehyde | 20 mg/m$^2$ |
| 2,4-Dichloro-6-hydroxy-1,3,5-triazine sodium salt | 10 mg/m$^2$ |
| Bis-vinylsulfonylmethyl ether | 36 mg/m$^2$ |
| Latex (L) | 0.2 g/m$^2$ |
| Polyacrylamide (molecular weight 10,000) | 0.1 g/m$^2$ |
| $C_9F_{19}$—O—$(CH_2CH_2O)_{11}$—H | 3 mg/m$^2$ |
| $C_8F_{17}SO_2N(C_3H_7)(CH_2CH_2O)_{15}$—H | 2 mg/m$^2$ |
| $C_8F_{17}SO_2N(C_3H_7)(CH_2CH_2O)_4$—$(CH_2)_4SO_3Na$ | 1 mg/m$^2$ |

The amount was per one side of the support, and the silver amount was 1.6 g/m$^2$ per one side of the support.

Solid fine particle dispersion dye (AH)

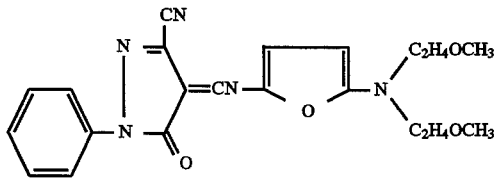

(solid dispersion of an average size of 0.1 μm)

Latex (L)

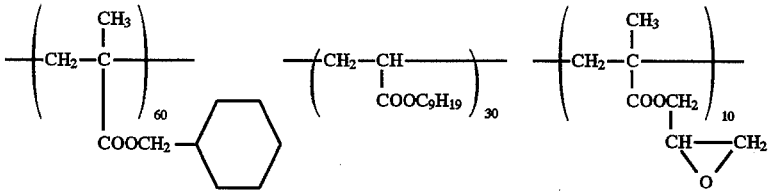

(Mw: about 80,000)

To each emulsion obtained above was added the following additives in an amount in terms of mol of silver.

| | |
|---|---|
| 2,6-Bis(hydroxyamino)-4-diethylamino-1,3,5-triazine | 5 mg |
| t-Butyl-catechol | 70 mg |
| Polyvinyl pyrrolidone (molecular weight 10,000) | 800 mg |
| Styrene-maleic acid anhydride copolymer | 2000 mg |
| Poly(sodium styrenesulfonate) | 1000 mg |
| Trimethylolpropane | 8000 mg |
| Nitrophenyl-triphenyl phosphonium chloride | 50 mg |
| Ammonium 1,3-dihydroxybenzene-4-sulfonic acid | 1500 mg |
| Sodium 2-mercaptobenzimidazole-5-sulfonate | 10 mg |
| n-$C_4H_9OCH_2CH(OH)CH_2N(CH_2COOH)_2$ | 700 mg |
| Collodal Silica | 1000 mg |
| Latex (L) | 800 mg |
| Dextrin (average molecular weight 1000) | 500 mg |

Gelatin was added to give 1.25 g/m$^2$ of light sensitive material.

| Third Layer (Protective Layer) | |
|---|---|
| Gelatin | 0.5 g/m$^2$ |
| Polymethylmethacrylate matting agent having an area average grain size of 7.0 μm) | 50 mg/m$^2$ |

A tablet developer replenisher was prepared in the following procedures (A) and (B).

Procedure (A)

In a bandam mill available on the market was pulverized 3000 g of hydroquinone, a developing agent to an average particle size of 10 μm. The resulting fine particles were added with 30,000 g of sodium thiosulfate and 2,500 g of potassium sulfite and 2,000 g of 1-phenyl-4-methyl-4-hydroxymethyl-3-pyrazolidone and mixed in a mill for 30 minutes. The resulting mixture was granulated by adding 30 ml of water at room temperature for about 10 minutes in a stirring granulator available on the market and dried at 40° C. for 2 hours in a fluid-bed drier to almost completely remove water. The resulting granules were uniformly mixed in a mixer with 100 g of polyethylene glycol 6000 at 25° C. and 40%RH or less, and the mixture was compression-tableted in an amount of 3.84 g per tablet, using Tough Press Correct Model 1527HU produced by Kikusui Seisakusho Co., Ltd., which was modified. Thus, 2,500 tablets of each of developer replenisher A2 were obtained.

Procedure (B)

DTPA of 100 g, 4000 g of potassium carbonate, 10 g of 5-methylbenzotriazole, 7 g of 1-phenyl-5-mercapto-tetrazole, 5 g of 2-mercaptohypoxantine, 500 g of KOH and N-acetyl-D,L-penicilamine were pulverized and granulated in the same manner as in Procedure (A). The addition amount of water was 30.0 ml. After the granulation, the granules were dried at 50° C. for 30 minutes to almost completely remove water. The resulting mixture was compression-tableted in an amount of 1.73 g per tablet, using Tough Press Correct Model 1527HU produced by Kikusui Seisakusho Co., Ltd., which was modified. Thus, 2,500 tablets of developer replenisher B2 were obtained.

A tablet fixer replenisher was prepared in the following procedures (C) and (D).

Procedure (C)

Ammonium thiosulfate/sodium thiosulfate (70/30, weight ratio) of 14,000 g and 1500 g of sodium sulfite were pulverized and mixed in a mixer available on the market. The resulting mixture was granulated by adding 500 ml of water in the same manner as in Procedure (A). After the granulation, the granules were dried at 60° C. for 30 minutes to almost completely remove water. The resulting granules were mixed with 4 g of sodium N-lauroylalanine in a commercial mixer at 25° C. and 40%RH or less for 3 minutes and compression-tableted in an amount of 6.202 g per tablet, using Tough Press Correct Model 1527HU producedby Kikusui Seisakusho Co., Ltd., which was modified. Thus, 2,500 tablets of fixer replenisher C2 were obtained.

Procedure (D)

Boric acid of 1000 g, 1500 g of aluminium sulfate octadecahydrate, 3000 g of sodium hydrogen acetate (obtained by mixing and drying an equimolucular glacial acetic acid and sodium acetate) and 200 g of tartaric acid were pulverized and granulated in the same manner as in Procedure (A). The addition amount of water was 100 ml. After the granulation, the granules were dried at 50° C. for 30 minutes to almost completely remove water. The resulting granules were mixed with 4 g of sodium N-lauroylalanine for 3 minutes and compression-tableted in an amount per tablet of 4.562 g, using Tough Press Correct Model 1527HU produced by Kikusui Seisakusho Co., Ltd., which was modified. Thus, 1,250 tablets of fixer replenisher D2 were obtained.

Developer Starter

| | |
|---|---|
| Glacial acetic acid | 2.98 g |
| KBr | 4.0 g |

Water was added to make 1 liter.

Twenty tablets of each of developer replenishers A2 and B2 were dissolved in diluting water to make 1 liter. To 16.5 liter of the solution prepared in that proportion were added 330 ml of the starter to prepare a developing starting solution. The developer tank was charged with the developing starting solution at the beginning of processing. Twenty tablets of of fixer replenisher C2 and 12.5 tablets of of fixer replenisher D2 were dissolved in diluting water to make 1 liter of a fixer starting solution. The fixer tank was charged with 9.2 liter of the fixer starting solution prepared in that proportion at the beginning of processing.

The pH of the developing starting solution was 10.45.

The above obtained light sensitive material was exposed to give a density of 1.0 after development and running processed. The processing was carried out using an automatic processor, SRX-502, which was modified in developing and fixing tank volumes and equipped with an incorporating member of solid tablet and further modified so that 45 second processing could be conducted. The volumes of the developer and fixer herein were 16.5 liter and 9.2 liter, respectively.

During the processing two tablets of the developer replenisher A2, two tablets of the developer replenisher B2 and 38 ml water were added per 0.62 $m^2$ of light sensitive material to a developer. When tablets A2 and B2 were dissolved in 20 ml water, the pH of the solution was 10.70. Two tablets of replenisher C2, one tablet of replenisher D2 and 37 ml of water were added per 0.62 $m^2$ of light sensitive material to the fixer.

Processing Conditions

| | | |
|---|---|---|
| Development | 35° C. | 8.2 seconds |
| Fixing | 33° C. | 5 seconds |
| Washing | Room Temp. | 4.5 seconds |
| Squeezing | | 1.6 seconds |
| Drying | 40° C. | 5.7 seconds |
| Total | | 29 seconds |

(Evaluation of Sensitivity and Fog)

The above prepared light sensitive material was stored for 12 hours at 40° C. and 50%RH. Thereafter, the resulting material was wedge exposed using a tungsten lamp, and processed using the above obtained automatic processor. Sensitivity of the processed material were measured as a reciprocal of exposure necessary to give a density of a fog density +1.0.

(Evaluation of Sensitivity and γ Variation)

The above prepared light sensitive material of 10×12 $inch^2$ was exposed to develop a half of the coated silver halide and processed at a rate to develop 4 moles of silver halide per hour, using the above obtained automatic processor. The light sensitive materials were processed before the processing and 30 minutes after the processing and sensitivity and γ (Fog+0.25−Fog+2.0) thereof were measured. Then, the differences between them was computed.

(Evaluation of Silver Tone)

The above obtained light sensitive material was exposed to give a density of 1.2, and development processed. The resulting material was visually evaluated in five evaluation ranks for the silver tone.

Rank 3 shows the lower limit of practical use, and rank 5 shows preferable black tone level.

The results are shown in Table 6.

TABLE 6

| Sample No. | AgI Content mol % | Coated Silver Amount g/$m^2$ | Silver Tone ranks | Sensitivity Variation ΔS/LogE | γ Variation | Remarks |
|---|---|---|---|---|---|---|
| 1 | 1 | 4 | 1 | −0.15 | 0.35 | Comparison |
| 2 | 1 | 3.5 | 2 | −0.12 | 0.30 | Comparison |
| 3 | 1 | 3 | 3 | −0.10 | 0.25 | Comparison |
| 4 | 1 | 2.7 | 4 | −0.09 | 0.20 | Comparison |
| 5 | 0.4 | 4 | 1 | −0.04 | 0.10 | Comparison |
| 6 | 0.4 | 3.5 | 2 | −0.04 | 0.10 | Comparison |
| 7 | 0.7 | 3 | 3 | −0.07 | 0.15 | Comparison |
| 8 | 0.4 | 3 | 3 | −0.03 | 0.05 | Invention |
| 9 | 0.1 | 3 | 3.5 | −0.02 | 0.03 | Invention |

TABLE 6-continued

| Sample No. | AgI Content mol % | Coated Silver Amount g/m$^2$ | Silver Tone ranks | Sensitivity Variation ΔS/LogE | γ Variation | Remarks |
|---|---|---|---|---|---|---|
| 10 | 0.4 | 2.7 | 4 | −0.02 | 0.03 | Invention |
| 11 | 0.1 | 2.7 | 5 | −0.01 | 0.02 | Invention |

As is apparent from the above results, the processing stability is effected when the developer amount of the developing tank is not less than 7 liters, the silver amount coated in a light sensitive material is not more than 3 g/m$^2$, and the silver iodide content of the silver halide emulsion is not more than 0.5 mol %. The effect is remarkable when the silver halide of the light sensitive material developed in a unit time is 0.8 to 5 mol.

What is claimed is:

1. A method for continuously processing an exposed silver halide photographic light sensitive material comprising the steps of:

developing said material with a developing solution; and fixing the developed material with a fixing solution, no other processing being carried out between said developing and said fixing, wherein said developing solution is replenished with a first water and a solid developing composition containing a developing agent and a first sulfite according to a processing amount of said material, and said fixing solution is replenished with a second water and a solid fixing composition containing a fixing agent and a second sulfite according to a processing amount of said material, said second sulfite being replenished in an amount of 0 to 0.05 mol per liter of said second water.

2. The method of claim 1, wherein said first sulfite is replenished in an amount of 0.3 mol or more per liter of said first water.

3. The method of claim 2, wherein said first sulfite is replenished in an amount of 0.45 to 1.5 mol per liter of said first water.

4. The method of claim 1, wherein said first water is replenished in an amount of not more than 300 ml of m$^2$ of processing amount of said material.

5. The method of claim 4, wherein said first water is replenished in an amount of 50 to 150 ml of m$^2$ of processing amount of said material.

6. The method of claim 1, wherein said second water is replenished in an amount of not more than 300 ml of m$^2$ of processing amount of said material.

7. The method of claim 6, wherein said first water is replenished in an amount of in an amount of 50 to 150 ml of m$^2$ of processing amount of said material.

8. The method of claim 1, wherein the solid developing composition satisfies the following expression:

$$[(M_{Na})/(M_K)]>1$$

wherein $M_{Na}$ represents a mol number of sodium sulfite contained in 1 g of the tablet developing composition; and $M_K$ represents a mol number of potassium sulfite contained in 1 g of the tablet developing composition.

9. The method of claim 1, wherein the developer contacts a solution containing an electrolyte through an ion exchange membrane and is electrified to remove a salt in the developer.

10. The method of claim 1, wherein the fixer contacts a solution containing an electrolyte through an ion exchange membrane and is electrified to remove a salt in the fixer.

11. The method of claim 1, wherein the processing speed of the light sensitive material is 20m$^2$ or more per hour.

* * * * *